US009750655B2

(12) United States Patent
Bhat et al.

(10) Patent No.: US 9,750,655 B2
(45) Date of Patent: Sep. 5, 2017

(54) CONFORMABLE SUPPORT SYSTEM

(71) Applicant: PRS Medical Technologies, Inc., Atherton, CA (US)

(72) Inventors: Nikhil Bhat, Fremont, CA (US); George Y. Choi, Atherton, CA (US); Allen J. Li, San Francisco, CA (US); Anuj Bhat, Pune (IN)

(73) Assignee: PRS Medical Technologies, Inc., Menlo Park, CA (US)

( * ) Notice: Subject to any disclaimer, the term of this patent is extended or adjusted under 35 U.S.C. 154(b) by 0 days.

(21) Appl. No.: 15/277,837

(22) Filed: Sep. 27, 2016

(65) Prior Publication Data

US 2017/0014288 A1 Jan. 19, 2017

Related U.S. Application Data

(62) Division of application No. 13/973,840, filed on Aug. 22, 2013, now Pat. No. 9,456,943.

(51) Int. Cl.
*A61G 7/057* (2006.01)
*A61G 7/00* (2006.01)

(52) U.S. Cl.
CPC ..... *A61G 7/05769* (2013.01); *A61G 7/001* (2013.01)

(58) Field of Classification Search
CPC ..... A61G 7/057
USPC ... 5/630, 636, 640, 644, 706, 710, 722, 654, 5/657
See application file for complete search history.

(56) References Cited

U.S. PATENT DOCUMENTS

| | | | | |
|---|---|---|---|---|
| 2,589,155 | A | 3/1952 | Smith | |
| 3,424,151 | A * | 1/1969 | Ericson | A61F 5/05816 128/DIG. 20 |
| 3,721,232 | A | 3/1973 | Trenchard | |
| 4,528,705 | A | 7/1985 | Greenawalt | |
| 4,726,624 | A | 2/1988 | Jay | |
| 4,730,610 | A | 3/1988 | Graebe | |
| 5,328,445 | A | 7/1994 | Spahn | |
| 5,544,378 | A | 8/1996 | Chow et al. | |
| 5,971,006 | A | 10/1999 | Seigerschmidt | |
| 8,052,630 | B2 | 11/2011 | Kloecker et al. | |
| 2003/0120191 | A1 | 6/2003 | Clement | |
| 2012/0253250 | A1 | 10/2012 | Spahn et al. | |
| 2015/0052685 | A1 | 2/2015 | Bhat et al. | |

FOREIGN PATENT DOCUMENTS

| | | |
|---|---|---|
| EP | 2197321 | 8/2012 |

* cited by examiner

*Primary Examiner* — Fredrick Conley
(74) *Attorney, Agent, or Firm* — Levine Bagade Han LLP

(57) ABSTRACT

A conforming support comprising a central portion, a first side portion attached to the central portion, and a second side portion attached to the central portion opposite to the first side portion each having chambers in fluid communication with one another such that a pressure applied upon the central chamber reconfigures the support assembly from a flattened configuration to an angled configuration in which fluid or gas within the central portion is urged into the first and/or second portions such that the side portions pivot to a predetermined height and angle relative to the central portion and form a conforming channel sized to support a region of a patient body.

20 Claims, 28 Drawing Sheets

190

200

210

220

192

202

212

222

CONFORMABLE SUPPORT SYSTEM

CROSS-REFERENCE TO RELATED APPLICATIONS

This application is a divisional of U.S. patent application Ser. No. 13/973,840 filed Aug. 22, 2013 (now U.S. Pat. No. 9,456,943), which is incorporated herein by reference in its entirety.

FIELD OF THE INVENTION

The present invention relates to devices and methods for preventing and treating pressure ulcers. More particularly, the present invention relates to devices and methods for preventing and treating pressure ulcers with cushioning supports which are adapted to move into conforming contact against various regions of a patient's body when the patient lies upon or otherwise applies a force or pressure upon the support.

BACKGROUND OF THE INVENTION

Individuals who are forced to sit or lie down for extended periods of time typically experience tissue necrosis over localized regions of their body known as decubitus ulcers or pressure sores. In 2009 more than a million people in acute care centers were affected with pressure ulcers. In addition to acute care centers, more than 500,000 people in long-term care centers are diagnosed with pressure ulcers every year. Pressure ulcers generally occur at locations of the body where the bony prominence is high and the underlying skin breaks down when constant pressure is placed against the skin. Blood circulation is inhibited or prevented in these localized areas and can even occur when the patient has been lying against or upon cushioning devices. Examples of areas of the body where pressure sores typically occur include the sacrum, greater trochanter, ischial tuberosity, malleolus, heel, etc. When pressure ulcers form, they can lead to extensive stays in the hospital or even to amputation.

Conventional cushioning devices generally utilize flexible materials such as foam or springs which allow for the cushion to deform and conform to the patient's body. While the cushioning device attempts to redistribute the loading from localized regions of the patient's body to a larger area over the rest of the body, such devices typically bottom out such that the patient's body contacts the underlying platform and nonetheless localizes the pressure onto the body.

Other cushioning devices have utilized fluid-filled cushions which consist of large single bladders or compartmentalized fluid or gas-filled bladders which inhibit fluid contained within the bladders from flowing laterally. In a fluid filled bladder disposed on a contoured seat, the fluid filled bladder typically bottoms out in one or more areas when supporting a patient's body weight. The places where the bladder bottoms out are sources of high localized pressure. Thus, such an assembly does not distribute pressure evenly across the portions of the anatomy in contact with the bladder. The amount of water that is used in such a bladder can be increased such that bottoming out does not occur. However, this design sacrifices stability. Additionally, since such cushions are typically designed to accommodate a wide range of patient populations, patients who are not as heavy as the maximum for which the cushion was designed for will suffer even more lack of stability than would be needed.

Another problem with simply increasing the amount of fluid to prevent bottoming out is that this requires significant volume of fluid beneath the patient and/or require specialized bedding. Additionally, many fluid filled membranes are too thick to provide adequate pressure relief because the hammocking that occurs in the regions of high protrusions. Thus, the suspension of the patient's body typically results in significantly non-uniform pressure application, with higher pressures being applied to protruding portions of the patient's body due to lack of adequate conformance of the bladder material to the patient's body.

Accordingly, there exists a need for a cushioning device which may conform to regions of the patient's body to prevent decubitis ulcers in a manner which is more cost efficient, convenient, and effective.

BRIEF SUMMARY OF THE INVENTION

A conformable support assembly may be configured to conform to particular regions of a patient's body where pressure ulcers tend to form, e.g., sacrum, trochanter, ischium, head, elbow, heel, as well as any other region of the body where support is desired. Such support is particularly desired when the patient sits, lies, or stands for an extended period of time.

The conformable support assembly may generally comprise a central portion defining a central chamber at least partially filled with a fluid or gas, a first side portion attached to the central portion and defining a first chamber at least partially filled with the fluid or gas, and a second side portion attached to the central portion opposite to the first side portion and also defining a second chamber at least partially filled with the fluid or gas. Each of the chambers are in fluid communication with one another such that a pressure applied upon the central chamber reconfigures the support assembly from a flattened configuration to an angled configuration in which the fluid or gas within the central chamber is urged into the first and/or second chamber such that the side portions pivot to a predetermined height and angle relative to the central portion and form a conforming channel sized to support a region of a patient body.

Generally in use, the conforming support assembly may be used to support a region of a patient's body by positioning the region of the patient's body upon the central portion. The support may then reconfigure the side portions from a flattened configuration to an angled configuration, where the fluid or gas within the central portion is urged into the first and/or second side portion such that the side portions pivot to a predetermined height and angle relative to the central portion and form a conforming channel sized to support the region of the patient's body.

A support assembly may be worn or used by an individual who may be bed-stricken for an extended period of time to prevent the formation of pressure ulcers. Such a support assembly may be placed against and/or beneath particular regions of the body where pressure ulcers tend to form. Various features which may be incorporated or included into the support assemblies described herein may be seen in further detail in the following U.S. patent application Ser. No. 13/189,320 filed Jul. 22, 2011 (U.S. Pub. 2013/0019873); Ser. No. 13/407,628 filed Feb. 28, 2012 (U.S. Pub. 2013/0019881); Ser. No. 13/683,198 filed Nov. 21, 2012; Ser. No. 13/693,691 filed Dec. 4, 2012; Ser. No. 13/760,482 filed Feb. 6, 2013; and Ser. No. 13/784,035 filed Mar. 4, 2013. Each of these applications is incorporated herein by reference in its entirety and for any purpose herein.

The conforming support may have a central section which may be positioned directly beneath the region of the patient's body. A first adjustable side section may be adjacent to the central section and a second adjustable side section may also be adjacent to the central section and oppositely positioned from the first adjustable side section. The conforming support may be fabricated from any number of materials which have some distensibility, e.g., polyurethane, vinyl, etc., and the thickness of the material may be varied anywhere from, e.g., 1 mil to 20 mil. Each of the sections may define an inflatable chamber into which a fluid (such as water, oil, etc.) or gas (such as air, etc.) or a combination of both and/or other conformable materials (such as foam, gel, etc.) may be introduced to at least partially or fully inflate each respective chamber.

Each of the respective chambers may have an elongate barrier separating them but with an interconnecting channel so that the chambers remain in fluid communication with one another. The cross-sectional areas of the interconnecting channels between each of the chambers may be varied in length or configuration (e.g., 0.5 inches or more in length) to provide for a controlled flow rate of fluid or air between each of the chambers as well as to provide for a dampening effect if so desired. Moreover, each of the elongate barriers (as well as the interconnecting channels) may be defined along hinged regions of the conforming support. The volume of fluid or gas within each of the chambers may be adjusted independently of one another through the respective ports although before and/or during use the fluid or gas within each of the chambers may flow between each of the interconnected chambers.

The pressure of the fluid or gas within the chambers may be such that when a load greater than a predetermined set value is applied, a majority of the fluid or gas in the central portion may be pushed to the two side portions. Moreover, the minimum volume of fluid or gas within the chambers may be correlated to the weight of the patient as the stiffness of the side portions may become stiffer at higher volumes.

In use, when an applied force or pressure is applied or placed upon the central portion such as when a patient's body (e.g., hips, torso, etc.) is placed upon the central portion, the central portion may become compressed such that the fluid or gas within the central chamber is forced into one or both of the side portions. Because of the respective hinged regions and the relative size differential between the compressed central portion and the side portions, each of the side portions may pivot along the hinged regions and raise up at an angle relative to the central portion (e.g., at least 5% to 10% from the initial position), as at least some volume of the fluid or gas within the central chamber is forced into each of the respective side chambers until the internal pressure of the conforming support reaches equilibrium since each of the chambers are fluidly connected. One illustrative example may have a ratio of the volume of fluid or gas in the side portions to the central portion increasing by at least 5% as the load is applied to the central portion.

The side portions may expand, fold, or otherwise become urged into contact against both or either side of the patient's body such that the support forms a conforming channel defined by the lifted side portions and the body becomes fully supported by the conforming support not only along the bottom of the body but along the sides as well. The reaction force on the side portions may result from a relatively stiffer reactive surface or platform underlying the conforming support causing them to lift or raise relative to the central portion. This reaction force can be greater than or equal to the force applied by the body on the system. Additional structures (e.g., pieces of foam, etc.) may be optionally positioned near the sides of the conforming support to further provide for a reactive surface against which the side portions may reconfigure.

The first edge of side portion may thus rise up from the platform and the first contact surface of the side portion may come into contact against a first side of the patient body and the second edge of side portion may likewise rise up from the platform and the second contact surface of the side portion may also come into contact against a second opposite side of the patient body. Moreover, enough fluid or gas may be introduced into the conforming support such that when the patient body is placed upon the central portion and the side portions are urged to angle and reconfigure into a supporting configuration, the patient's body may remain supported particularly along the central portion and prevented from bottoming-out into contact against the platform beneath the support.

The angle and height to which the side portions raise up relative to the central portion to conform against the body may varied depending upon the desired results. For instance, the conforming support may be pre-filled prior to the patient body being placed upon the support or it may be filled after the patient body is placed upon the support. In either case, the fluid or gas may be introduced into and/or withdrawn from the support to create a low air loss feature with constant flow of the fluid or gas. Moreover, the resistive force provided by the conforming support may be function of a number of factors, e.g., weight of the patient or weight of the particular supported region (applied load), volume of fluid or gas within each of the chambers, pressure of the fluid or gas within each of the chambers, etc. To achieve a low loss of the fluid or gas within the support, an active pump may be optionally used to fill the system from one or more of its ports or the inflation ports may alternatively share a common inlet to achieve a more uniform fill. Once the patient body is fully supported and out of contact with the underlining platform, the volume of fluid or gas within the support may be further adjusted as desired.

The conforming support may further function as an assistive device for facilitating the patient (particularly elderly, pregnant women, infirm, etc.) to reposition or turn from one side of the body to the other. As the patient turns upon the conforming support, the fluid or gas may be pushed or urged from one side portion to the central portion and/or other side portion thereby elevating and inclining those portions and providing leverage to lift the patient up gently as they turn.

In alternative variations, the side portions may be fluidly coupled to allow for the fluid or gas to pass between one another depending upon the body positioning of the patient. The central portion may be fluidly isolated from the side portions such that the volume of fluid or gas within remains unchanged even when the patient lies upon the support.

While the conforming support may be fabricated from any number of suitable materials, optional vents or openings may be defined along the surface of the support to allow some of the fluid or gas to leave or vent from the support. This venting may provide some convective dissipation of heat when in direct contact with patient's body. In the event that some of the fluid or gas is vented form the support, the mass or volume of fluid or gas exiting the support ideally reaches equilibrium with the mass or volume of fluid or gas entering the system (e.g., via one or more pumps) thus creating a constant flow to ensure that the conforming support continues to provide support to the patient body. Additionally and/or alternatively, the outer surface of the support may also be made with any number of breathable materials to further allow for moisture transmission and conductive dissipation of heat from the patient's body.

In another variation, the central portion of the conforming support may be segmented into a number of sub-chambers which can also be baffled to prevent or inhibit any bulging effects over the central portion. The central portion may include, e.g., four separate sub-chambers which may be aligned in parallel with the respective side portions. However, the central portion may be configured to have fewer than four or more than four sub-chambers. Additionally, each of the sub-chambers may each be separated by respective barriers having interconnecting channels to allow for fluid communication between adjacent sub-chambers.

Generally, the conforming support may range in overall width anywhere from, e.g., greater than 5 inches such as between 20 to 45 inches, with an overall length of, e.g., greater than 5 inches such as between 8 to 25 inches. Each of the sub-chambers may each have a width of, e.g., 2 inches or greater. The overall volume of fluid or gas within the chambers may also range anywhere from, e.g., 0 to 5 liters or more. When the conforming support is in its flattened and unloaded configuration, the conforming support may have a height of, e.g., 0.25 inches or more, with a conforming angle of, e.g., 0 degrees.

The first and/or second edges of the respective side portions may raise up to a conforming height (e.g., ranging from less than 1 inch to 12 inches or up to 20 inches) relative to the platform and one or both side portions may form a conforming angle (e.g., ranging from 0 to 135 degrees, or preferably 30 to 60 degrees, or preferably 90 degrees) relative to the horizontal position of the central portion to bring the contact surfaces into conforming contact against one or both sides of the patient body. While the central portion may have a width of up to, e.g., 30 inches, the width may be varied depending upon the portion of the patient's body being supported as well as the anatomy of the patient. For instance, while an exemplary width of 30 inches may accommodate a patient's hips or torso, the central portion may be reduced for supporting other regions of the patient such as the head, elbows, heels, etc. Similarly, the side portions may also have a width ranging anywhere from, e.g., 1 to 20 inches, depending upon the desired region of the body for supporting.

In either case, the width of the central portion may be adjusted or varied to ensure that the side portions come into contact against the patient's body to provide sufficient support when the patient lies upon central portion. Moreover, the adjustment and size range for the height as well as the conforming angle and width of the central section may be applicable not only to the variation shown here but to any and all other variations shown and described herein.

Aside from the conforming support, an additional secondary support may be optionally placed upon the conforming support to provide for additional support and comfort to the patient body. This secondary support may help to ensure a uniform pressure distribution and while maximizing the surface area of contact to the surface of the body. Such a secondary support may be separate from, directly integrated, or otherwise attached to the conforming support and may move into conforming contact directly against the patient body. The secondary support may be comprised of a central portion having a first adjustable side portion and a second adjustable side portion opposite to the first portion where each portion is separated from one another via a respective barrier but also define openings to allow for fluid communication between each adjacent portion similar to the conforming support described above.

The width of the central portion may be similar to or the same as (although the dimensions may also be varied) the conforming support to ensure that positioning of the secondary support upon the conforming support will align properly. Thus, when a force or pressure is placed upon the central portion, the side portions may be allowed to raise up to a conforming height and a conforming angle to further align with the underlying conforming support.

In some variations, the secondary support may be filled with, e.g., a fluid such as water, while the underlying conforming support may be filled with, e.g., a gas such as air, to provide for a combination. In other variations, the secondary support may be filled with, e.g., a gas such as air, while the underlying conforming support may be filled with, e.g., a fluid such as water. While in other variations, both supports may be filled with either a fluid or a gas or a mixture of both. In yet another variation, an additional layer of material such as foam may be placed beneath the conforming support, between the secondary support and conforming support, above the secondary support, or all of these locations. In yet another variation of the secondary support, the secondary support may be comprised of a single chambered structure filled with the fluid or gas. The entire secondary support may be simply secured upon the underlying conforming support. Yet another of the secondary support may include one or more pods which may be filled with a fluid or gas or combination of both.

The pods may generally be separated from one another such that no fluid communication occurs between the pods or with the secondary support and each of the pods may be filled with the fluid or gas or both as described above. Although in alternative variations, some fluid communication may be provided between one or more of the pods. Additionally, the one or more pods may each occupy an envelope of, e.g., 1 cm×1 cm×0.5 cm to about 3 cm×3 cm×3 cm, in an uncompressed state and they may be formed into various shapes, e.g., spherical, cylindrical, cubical, etc. Moreover, each of the pods may be formed from various materials such as polyurethane, silicone, vinyl, nylon, polyethylene vinyl acetate (PEVA), etc. having a thickness ranging from, e.g., 0.1 mm to 5 mm.

While the various supports described having incorporated conforming support structures have fluidly coupled chambers to provide for fluid transfer between the different chambers, another variation of a conforming support may have each portion define a chamber which is fluidly isolated from one another. Each of the chambers may be at least partially inflated and/or deflated prior to or during use through their respective ports with any of the fluids and/or gases, as previously described, to ensure that the patient is adequately supported and does not contact the underlying platform or surface.

When a load is applied upon the central portion such as when the patient lies upon or places a portion of their body upon the support, the side portions may be individually adjusted by further inflating and/or deflating their respective chambers to ensure that the side portions are able to angle and lift against the underlying platform or surface relative to the central portion. Moreover, because the internal pressure of each of the portions need not be uniform, they may be individually adjusted to accommodate different patient body types or to induce tilting of the patient to their side. The fluidly disconnected conforming system may be similarly combined with any of the secondary supports as well.

Regardless of which variation is utilized, any of the conforming supports and/or support assemblies may be incorporated with other active or non-active support surfaces, e.g., beds, mattresses, wheelchairs, seats, etc., and perform with the same functionality. With any of the variations described herein, different features and aspects from each of the variations may be combined with one another in various combinations.

BRIEF DESCRIPTION OF THE DRAWINGS

FIGS. 15A to 15C show perspective views of yet another variation of a secondary support positioned upon a conforming support and one or more pods positioned in-between.

DETAILED DESCRIPTION OF THE INVENTION

Generally, in a healthy individual, the presence of muscle mass and soft tissue usually functions to distribute and relieve pressure from bony protuberances of the body contacted against the underlying surface. However, when a patient is forced to lie on one portion of their body for extended periods of time, areas such as the sacrum or trochanter (or other portions of the body such as the heel, elbow, head, etc.) may compress a region of the skin and tissue between the protuberance and a contact region formed against the underlying surface.

Typical pressures generated in the hip area for healthy individuals lying against a surface may range around 4 kPa. However, for older and/or diseased individuals, the contact pressures between regions of bony prominence and the skin is generally higher due to various factors such as muscle atrophy. For instance, increased pressures were found to range around 7.3 kPa for such older individuals. Blood circulation becomes restricted and tissue necrosis typically begins when pressures range above 4.3 kPa leading to the development of pressure ulcers.

A support assembly may be worn or used by an individual who may be bed-stricken for an extended period of time to prevent the formation of pressure ulcers. Such a support assembly may be placed against and/or beneath particular regions of the body where pressure ulcers tend to form, e.g., sacrum, trochanter, ischium, head, elbow, heel, as well as any other region of the body where support is desired. The support assembly may be formed into a configuration to be conformed against the patient's body, e.g., around the hips or lower back, or a portion of the body, e.g., around the ankles or feet. Various features which may be incorporated or included into the support assemblies described herein may be seen in further detail in the following U.S. patent application Ser. No. 13/189,320 filed Jul. 22, 2011 (U.S. Pub. 2013/0019873); Ser. No. 13/407,628 filed Feb. 28, 2012 (U.S. Pub. 2013/0019881); Ser. No. 13/683,198 filed Nov. 21, 2012; Ser. No. 13/693,691 filed Dec. 4, 2012; Ser. No. 13/760,482 filed Feb. 6, 2013; and Ser. No. 13/784,035 filed Mar. 4, 2013. Each of these applications is incorporated herein by reference in its entirety and for any purpose herein.

Figure 1A:
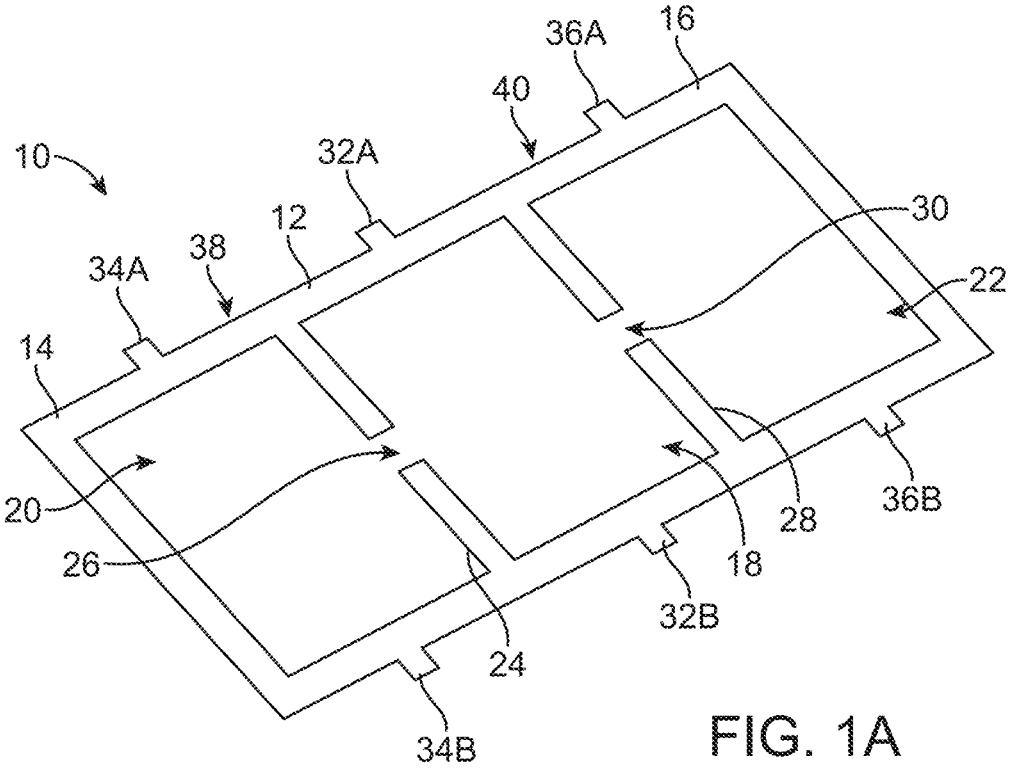
FIG. 1A shows a perspective internal view of one variation of a conforming support layer having multiple chambers which are fluidly interconnected with one another.

Generally, the conforming support assembly may comprise a conforming support 10 which is configured and sized for placement beneath and/or against a region of the patient's body, as described. The conforming support 10 may have a central section 12 which may be positioned directly beneath the region of the patient's body. A first adjustable side section 14 may be adjacent to the central section 12 and a second adjustable side section 16 may also be adjacent to the central section 12 and oppositely positioned from the first adjustable side section 14, as shown in the perspective view of FIG. 1A. The conforming support 10 may be fabricated from any number of materials which have some distensibility, e.g., polyurethane, vinyl, etc., and the thickness of the material may be varied anywhere from, e.g., 1 mil to 20 mil.

Each of the sections may define an inflatable chamber into which a fluid (such as water, oil, etc.) or gas (such as air, etc.) or a combination of both and/or other conformable materials (such as foam, gel, etc.) may be introduced to at least partially or fully inflate each respective chamber. For instance, the central section 12 may define a central chamber 18, first side section 14 may define a first side chamber 20, and second side section 16 may define second side chamber 22.

While each chamber may be separately inflated and/or deflated by respective ports 32A, 32B fluidly coupled to central chamber 12, ports 34A, 34B fluidly coupled to first side chamber 20, and ports 36A, 36B fluidly coupled to second side chamber 22, each of the respective chambers may have an elongate barrier separating them but with an interconnecting channel so that the chambers remain in fluid communication with one another. Central chamber 18 may be seen separated from first side chamber 20 by barrier 24 but may remain fluidly coupled via interconnecting channel 26 defined along barrier 24. Likewise, central chamber 18 may also be seen separated from second side chamber 22 by barrier 28 but may remain fluidly coupled via interconnecting channel 30 defined along barrier 28. The cross-sectional areas of the interconnecting channels 26, 30 between each of the chambers may be varied in length or configuration (e.g., 0.5 inches or more in length) to provide for a controlled flow rate of fluid or air between each of the chambers as well as to provide for a dampening effect if so desired. While more than one interconnecting channel 26, 30 may be present along the barriers, the channels may each be of uniform size or they may be sized alternately or arbitrarily or any number of different combinations, if so desired. Moreover, each of the elongate barriers 24, 28 (as well as interconnecting channels 26, 30) may be defined along hinged regions 38, 40 of the conforming support 10.

Figure 1B:
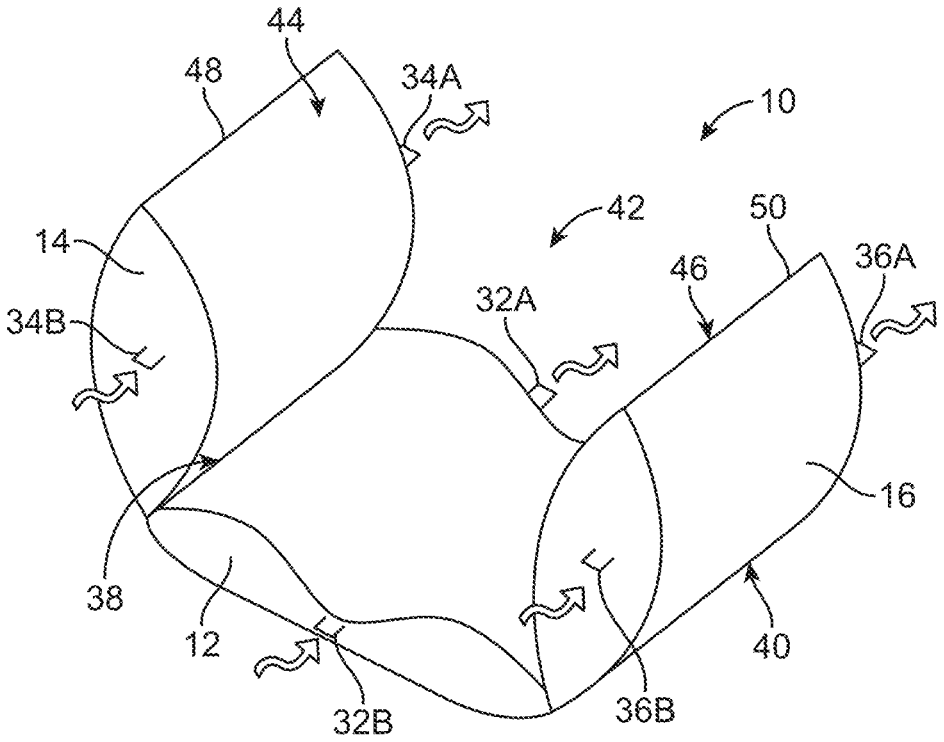
FIG. 1B shows a perspective view of the conforming support layer when inflated and urged into its supportive configuration.

As shown in FIG. 1B, the conforming support 10 is shown when at least partially inflated and in its conforming configuration where the side portions 14 and 16 are free to rotate or pivot along their respective hinged regions 38, 40. The volume of fluid or gas within each of the chambers 18, 20, 22 may be adjusted independently of one another through the respective ports, as shown, although before and/or during use the fluid or gas within each of the chambers 18, 20, 22 may flow between each of the interconnected chambers.

Figure 2A:
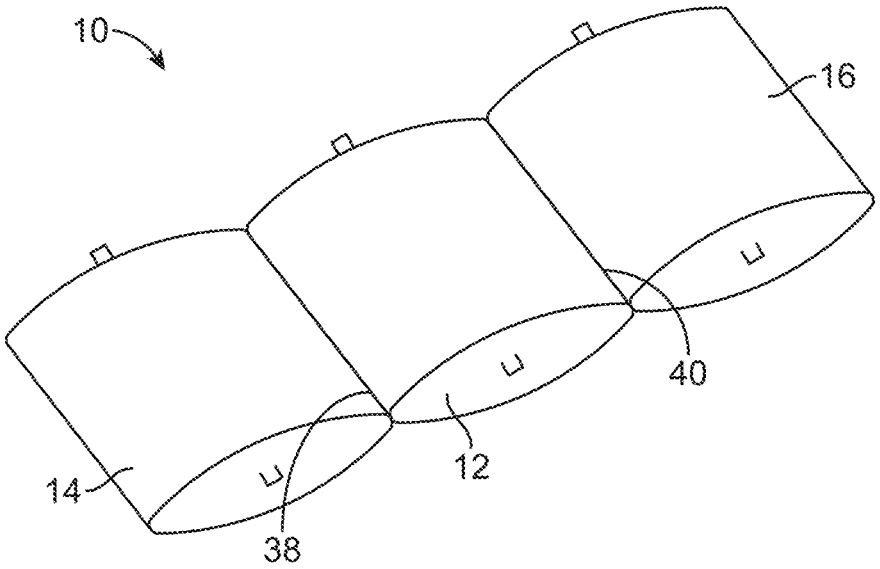
FIG. 2A shows a perspective view of the conforming support layer when it is at least partially filled and laid into an extended configuration.

FIG. 2A illustrates a perspective view of the conforming support 10 which is at least partially inflated and when in its expanded configuration where the support 10 is laid out. The pressure of the fluid or gas within the chambers may be such that when a load greater than a predetermined set value is applied, a majority of the fluid or gas in the central portion 12 may be pushed to the two side portions 14, 16. Moreover, the minimum volume of fluid or gas within the chambers may be correlated to the weight of the patient as the stiffness of the side portions 14, 16 may become stiffer at higher volumes.

Figure 2B:
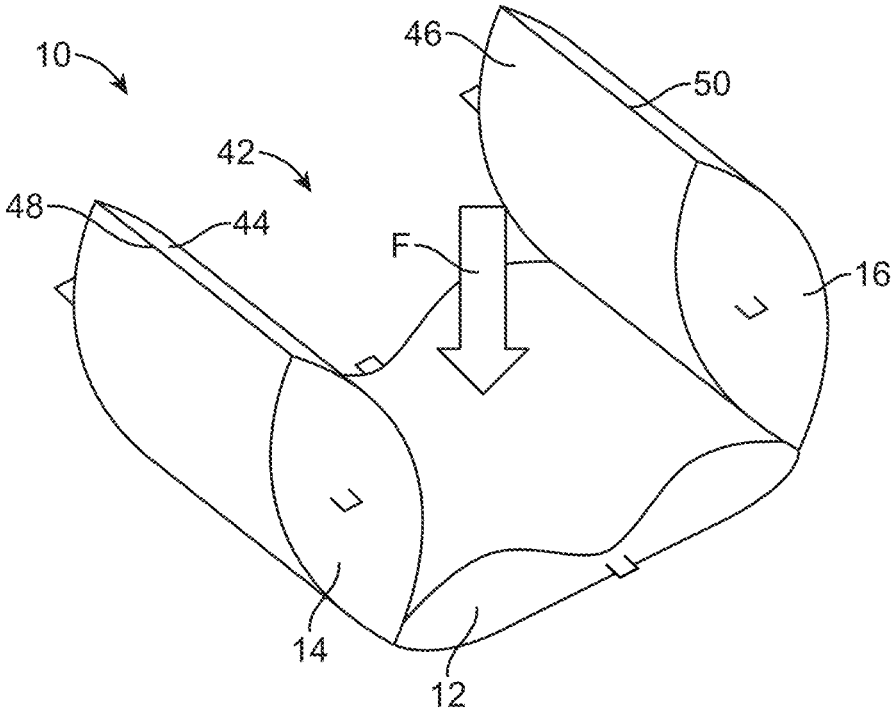
FIG. 2B illustrates how the side sections may automatically angle and adjust relative to the central section when a force is applied to the central section.

In use, when an applied force or pressure F is applied or placed upon the central portion 12 such as when a patient's body (e.g., hips, torso, etc.) is placed upon the central portion 12, the central portion 12 may become compressed such that the fluid or gas within the central chamber is forced into one or both of the side portions 14, 16. Because of the respective hinged regions 38, 40 and the relative size differential between the compressed central portion 12 and the side portions 14, 16, each of the side portions 14, 16 may pivot along the hinged regions 38, 40 and raise up at an angle relative to the central portion 12 (e.g., at least 5% to 10% from the initial position), as shown in the perspective view of FIG. 2B, as at least some volume of the fluid or gas within the central chamber 18 is forced into each of the respective side chambers 20, 22 until the internal pressure of the conforming support 10 reaches equilibrium since each of the chambers are fluidly connected. One illustrative example may have a ratio of the volume of fluid or gas in the side portions 14, 16 to the central portion 12 increasing by at least 5% as the load is applied to the central portion 12.

The side portions 14, 16 may expand, fold, or otherwise become urged into contact against both or either side of the patient's body such that the support 10 forms a conforming channel 42 defined by the lifted side portions 14, 16 and the body becomes fully supported by the conforming support 10 not only along the bottom of the body but along the sides as well. The reaction force on the side portions 14, 16 may result from a relatively stiffer reactive surface or platform underlying the conforming support 10 causing them to lift or raise relative to the central portion 12. This reaction force can be greater than or equal to the force applied by the body on the system. Additional structures (e.g., pieces of foam, etc.) may be optionally positioned near the sides of the conforming support 10 to further provide for a reactive surface against which the side portions 14, 16 may reconfigure.

The first edge 48 of side portion 14 may thus rise up from the platform and the first contact surface 44 of side portion 14 may come into contact against a first side of the patient body and the second edge 50 of side portion 16 may likewise rise up from the platform and the second contact surface 46 of side portion 16 may also come into contact against a second opposite side of the patient body. Moreover, enough fluid or gas may be introduced into the conforming support 10 such that when the patient body is placed upon the central portion 12 and the side portions 14, 16 are urged to angle and reconfigure into a supporting configuration, the patient's body may remain supported particularly along the central portion 12 and prevented from bottoming-out into contact against the platform beneath the support 10.

The angle and height to which the side portions 14, 16 raise up relative to the central portion 12 to conform against the body may varied depending upon the desired results. For instance, the conforming support 10 may be pre-filled prior to the patient body being placed upon the support 10 or it may be filled after the patient body is placed upon the support 10. In either case, the fluid or gas may be introduced into and/or withdrawn from the support 10 to create a low air loss feature with constant flow of the fluid or gas. Moreover, the resistive force provided by the conforming support 10 may be function of a number of factors, e.g., weight of the patient or weight of the particular supported region (applied load), volume of fluid or gas within each of the chambers, pressure of the fluid or gas within each of the chambers, etc. To achieve a low loss of the fluid or gas within the support 10, an active pump may be optionally used to fill the system from one or more of its ports or the inflation ports may alternatively share a common inlet to achieve a more uniform fill. Once the patient body is fully supported and out of contact with the underlining platform, the volume of fluid or gas within the support 10 may be further adjusted as desired.

Because placing a force F or pressure upon the central portion 12 urges the side portions 14, 16 to raise or angle automatically due to the fluid or gas being forced into the respective portions 14, 16, the conforming support 10 may further function as an assistive device for facilitating the patient (particularly elderly, pregnant women, infirm, etc.) to reposition or turn from one side of the body to the other. As the patient turns upon the conforming support 10, the fluid or gas may be pushed or urged from one side portion to the central portion 12 and/or other side portion thereby elevating and inclining those portions and providing leverage to lift the patient up gently as they turn. Thus, a portion of the patient's body may be elevated opposite to a direction of the patient turning via the central and/or side portions 14, 16 such that the patient body is lifted and assisted in repositioning or turning.

In alternative variations, the side portions 14, 16 may be fluidly coupled to allow for the fluid or gas to pass between one another depending upon the body positioning of the patient. The central portion 12 may be fluidly isolated from the side portions 14, 16 such that the volume of fluid or gas within remains unchanged even when the patient lies upon the support.

While the conforming support may be fabricated from any number of suitable materials, optional vents or openings may be defined along the surface of the support 10 to allow some of the fluid or gas to leave or vent from the support 10. This venting may provide some convective dissipation of heat when in direct contact with patient's body. In the event that some of the fluid or gas is vented form the support 10, the mass or volume of fluid or gas exiting the support 10 ideally reaches equilibrium with the mass or volume of fluid or gas entering the system (e.g., via one or more pumps) thus creating a constant flow to ensure that the conforming support 10 continues to provide support to the patient body. Additionally and/or alternatively, the outer surface of the support 10 may also be made with any number of breathable materials to further allow for moisture transmission and conductive dissipation of heat from the patient's body.

Figure 3A:
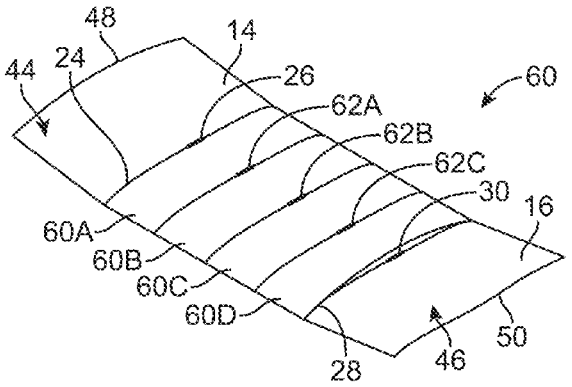
FIGS. 3A and 3B show perspective and end views of another variation of the conforming support having multiple chambers.
Figure 3B:
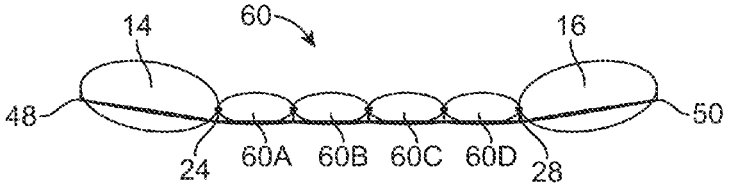

In another variation, FIGS. 3A and 3B show perspective and end views of another variation where the central portion 60 of the conforming support may be segmented into a number of sub-chambers which can also be baffled to prevent or inhibit any bulging effects over the central portion 60. The central portion 60 is shown as having four separate sub-chambers 60A, 60B, 60C, 60D which may be aligned in parallel with the respective side portions 14, 16. However, the central portion 60 may be configured to have fewer than four or more than four sub-chambers. Additionally, each of the sub-chambers 60A, 60B, 60C, 60D may each be separated by respective barriers having interconnecting channels 62A, 62B, 62C to allow for fluid communication between adjacent sub-chambers.

Generally, the conforming support may range in overall width anywhere from, e.g., greater than 5 inches such as between 20 to 45 inches, with an overall length of, e.g., greater than 5 inches such as between 8 to 25 inches. Each of the sub-chambers 60A, 60B, 60C, 60D may each have a width of, e.g., 2 inches or greater. The overall volume of fluid or gas within the chambers may also range anywhere from, e.g., 0 to 5 liters or more. When the conforming support is in its flattened and unloaded configuration, the conforming support may have a height of, e.g., 0.25 inches or more, with a conforming angle of, e.g., 0 degrees.

Figure 4A:
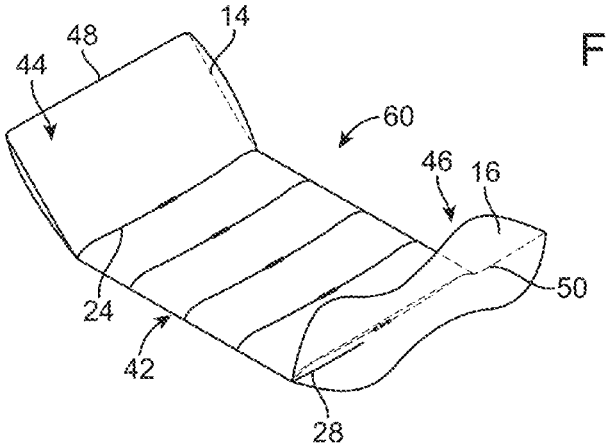
FIGS. 4A and 4B show perspective and end views of the multiple chamber conforming support with the side sections automatically urged into their supporting configuration when the chambers of the central portion are compressed.
Figure 4B:
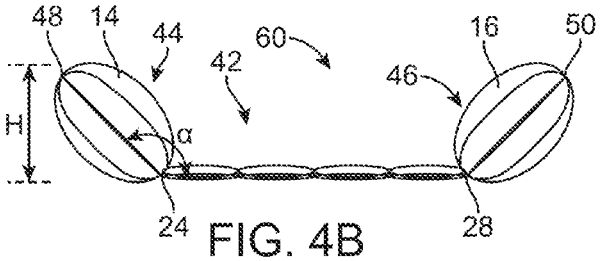

FIGS. 4A and 4B show perspective and end views of the conforming support of FIGS. 3A and 3B when the central portion 60 of the support has been compressed such as when a patient is resting upon the support. As described above, the fluid or gas contained within each of the sub-chambers 60A, 60B, 60C, 60D may be urged or forced to flow towards one or both side portions 14, 16. The increase in volume and pressure within the side portions 14, 16 may cause it to expand and raise up from the platform at an angle from its flattened configuration shown in FIG. 3B to its conforming configuration shown in FIG. 4B.

The first and/or second edges 48, 50 of the respective side portions 14, 16 may raise up to a conforming height H (e.g., ranging from less than 1 inch to 12 inches or up to 20 inches) relative to the platform and one or both side portions 14, 16 may form a conforming angle α (e.g., ranging from 0 to 135 degrees, or preferably 30 to 60 degrees, or preferably 90 degrees) relative to the horizontal position of the central portion 60 to bring the contact surfaces 44, 46 into conforming contact against one or both sides of the patient body. While the central portion 60 may have a width of up to, e.g., 30 inches, the width may be varied depending upon the portion of the patient's body being supported as well as the anatomy of the patient. For instance, while an exemplary width of 30 inches may accommodate a patient's hips or torso, the central portion 60 may be reduced for supporting other regions of the patient such as the head, elbows, heels, etc. Similarly, the side portions 14, 16 may also have a width ranging anywhere from, e.g., 1 to 20 inches, depending upon the desired region of the body for supporting.

In either case, the width of the central portion 60 may be adjusted or varied to ensure that the side portions 14, 16 come into contact against the patient's body to provide sufficient support when the patient lies upon central portion 60. Moreover, the adjustment and size range for the height H as well as the conforming angle α and width of the central section 60 may be applicable not only to the variation shown here but to any and all other variations shown and described herein.

Figure 5A:
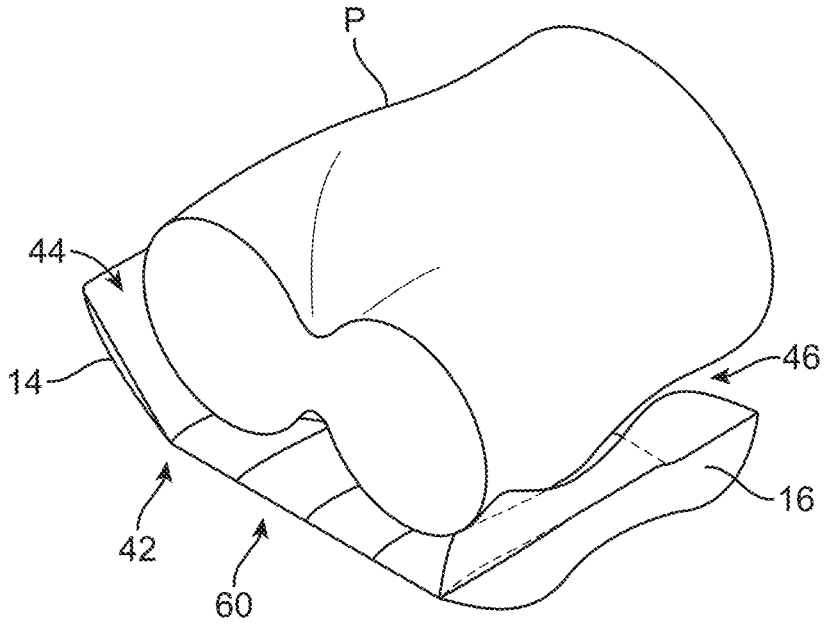
FIGS. 5A and 5B show perspective and end views of the multiple chamber conforming support illustrating how the side portions are automatically angled relative to the central portion and into contact against the patient's body when the patient lies upon the support.
Figure 5B:
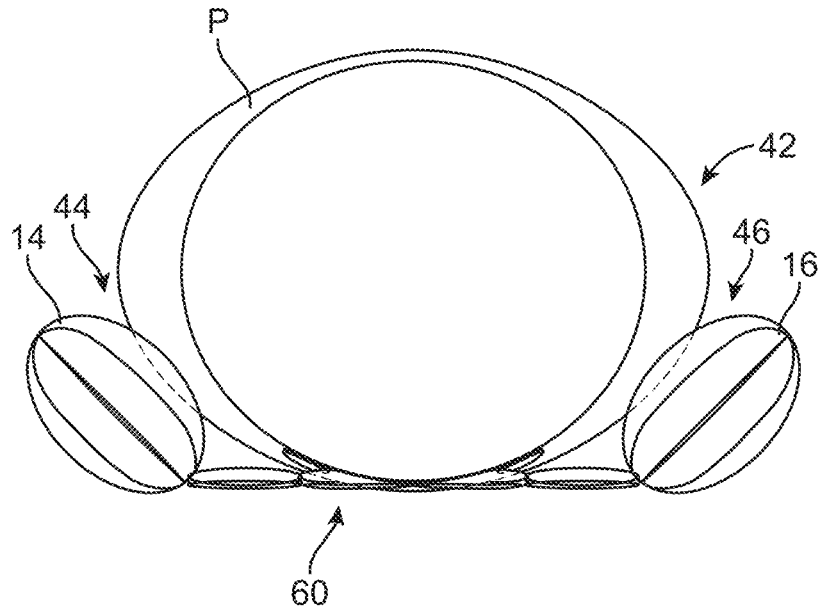

FIGS. 5A and 5B show perspective and end views of a conforming support with a patient body P placed upon the central portion 60. As illustrated, once the patient body P has been placed upon the central portion 60, the fluid or gas within each of the chambers is urged to flow into one or both of the side portions 14, 16. With the increase in volume and pressure, the side portions 14, 16 may expand in size and reconfigure from its relatively flattened configuration into its conforming configuration where the side portions 14, 16 increase in conforming height and angle relative to the platform as well as the central portion 60. The conforming surfaces 44, 46 of the respective side portions 14, 16 may thus move automatically into contact against the sides of the patient body P, as shown in FIG. 5B, to provide support while also continuing to provide support beneath the patient body P along central portion 60. Moreover, the central portion 60 may still retain enough fluid or gas to prevent the patient body P from bottoming-out or directly contacting the underlying support or platform upon which the conforming support is placed.

Figure 6A:
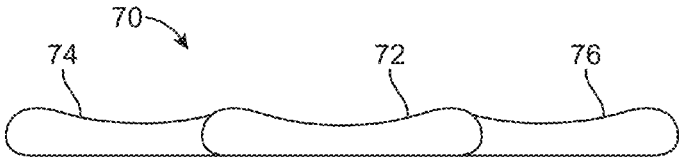
FIGS. 6A and 6B show end and perspective views of a secondary support which may be used in combination with the conforming support.
Figure 6B:
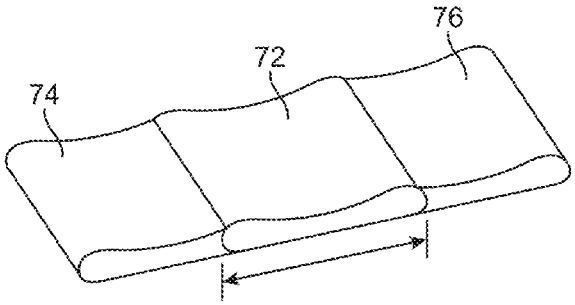

Aside from the conforming support, an additional secondary support may be optionally placed upon the conforming support to provide for additional support and comfort to the patient body. This secondary support may help to ensure a uniform pressure distribution and while maximizing the surface area of contact to the surface of the body. Such a secondary support may be separate from, directly integrated, or otherwise attached to the conforming support and may move into conforming contact directly against the patient body. The secondary support 70 may be comprised of a central portion 72 having a first adjustable side portion 74 and a second adjustable side portion 76 opposite to the first portion 74 where each portion is separated from one another via a respective barrier but also define openings to allow for fluid communication between each adjacent portion, as shown in the end and perspective views of FIGS. 6A and 6B, similar to the conforming support described above.

Figure 7A:
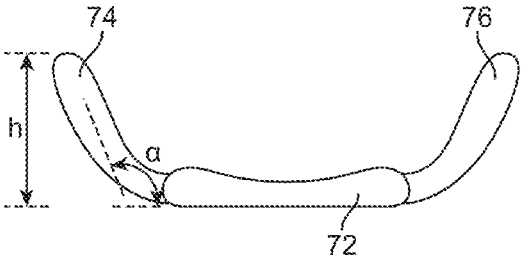
FIGS. 7A and 7B show end and perspective views of the second support reconfigured from its flattened shape into its angled shape.
Figure 7B:
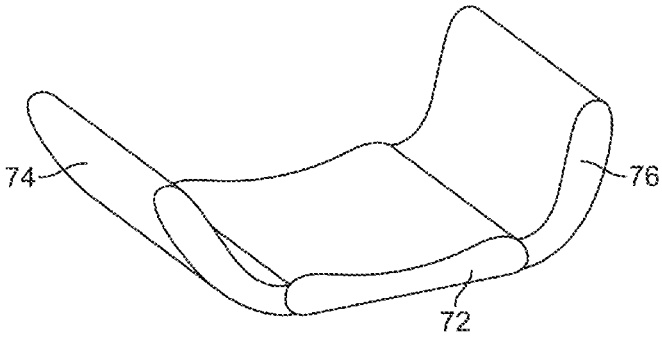

The width of the central portion 72 may be similar to or the same as (although the dimensions may also be varied) the conforming support to ensure that positioning of the secondary support 70 upon the conforming support will align properly. Thus, when a force or pressure is placed upon the central portion 72, the side portions 74, 76 may be allowed to raise up to a conforming height h and a conforming angle α to further align with the underlying conforming support, as shown in the end and perspective views of FIGS. 7A and 7B which illustrate how the side portions 74, 76 may be reconfigured into their conforming configuration.

In some variations, the secondary support may be filled with, e.g., a fluid such as water, while the underlying conforming support may be filled with, e.g., a gas such as air, to provide for a combination. In other variations, the secondary support may be filled with, e.g., a gas such as air, while the underlying conforming support may be filled with, e.g., a fluid such as water. While in other variations, both supports may be filled with either a fluid or a gas or a mixture of both. In yet another variation, an additional layer of material such as foam may be placed beneath the conforming support, between the secondary support and conforming support, above the secondary support, or all of these locations.

Figure 8A:
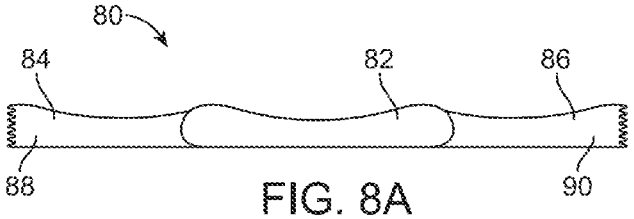
FIGS. 8A and 8B show end and perspective views of another variation of a secondary support having bellow-type side portions which may be used in combination with the conforming support.
Figure 8B:
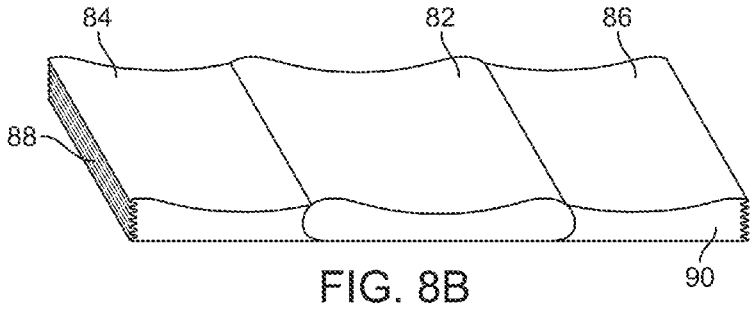
Figure 9A:
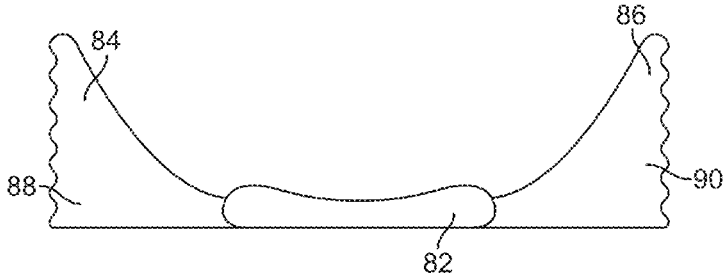
FIGS. 9A and 9B show end and perspective views of the second support having the bellow-type side portions expanded into conforming support.
Figure 9B:
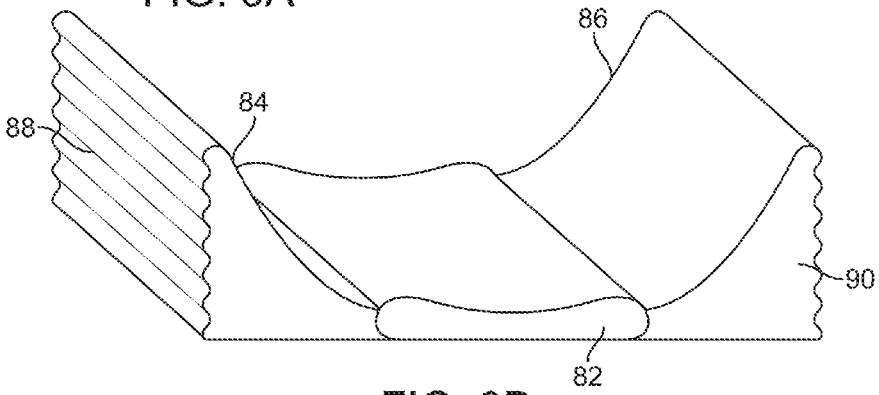

Another variation of the secondary support is illustrated in the end and perspective views of FIGS. 8A and 8B which show a secondary support 80 having a central portion 82 and a first adjustable side portion 84 and a second adjustable side portion 86 in its flattened configuration. In this variation, however, the side portions 84, 86 may be formed as bellowed portions 88, 90 which are configured to expand or reconfigure into an angled portion with a bellow-type structure, as shown in the end and perspective view of FIGS. 9A and 9B. When the patient lies upon the central portion 82 such that the portion 82 becomes depressed, the fluid or gas within the central portion 82 may enter into the respective side portions 84, 86 such that the portions extend into the bellowed configuration to support the patient body.

Figure 10A:
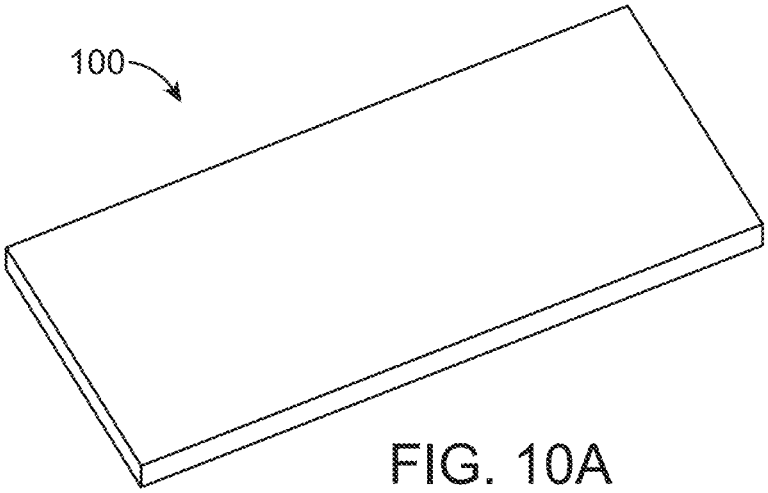
FIG. 10A shows a perspective view of a secondary support variation which is formed into a single chamber support.
Figure 10B:
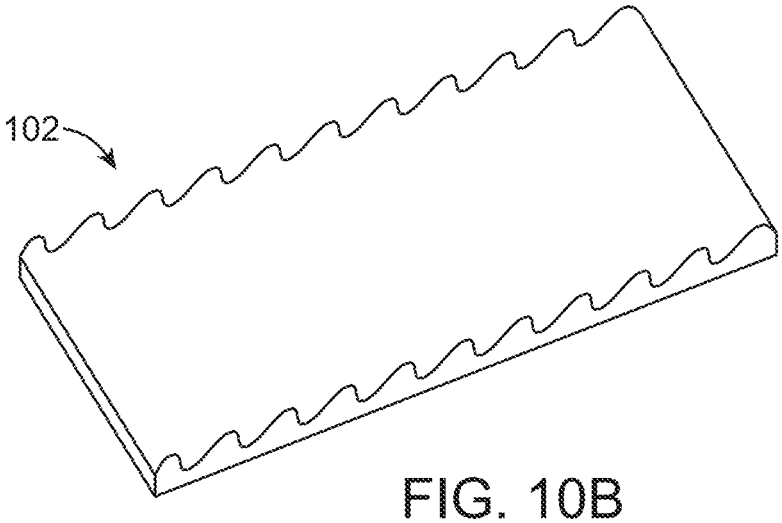
FIG. 10B shows a perspective view of another variation of the secondary support having a surface which may be textured, varied, or non-uniform.

In yet another variation of the secondary support, FIG. 10A shows a perspective view of a secondary support 100 which may be comprised of a single chambered structure filled with the fluid or gas. The entire secondary support 100 may be simply secured upon the underlying conforming support. Another variation of a secondary support 102 is shown in the perspective view of FIG. 10B which illustrates the secondary support 102 having an undulating or non-uniform conforming surface.

Figure 10C:
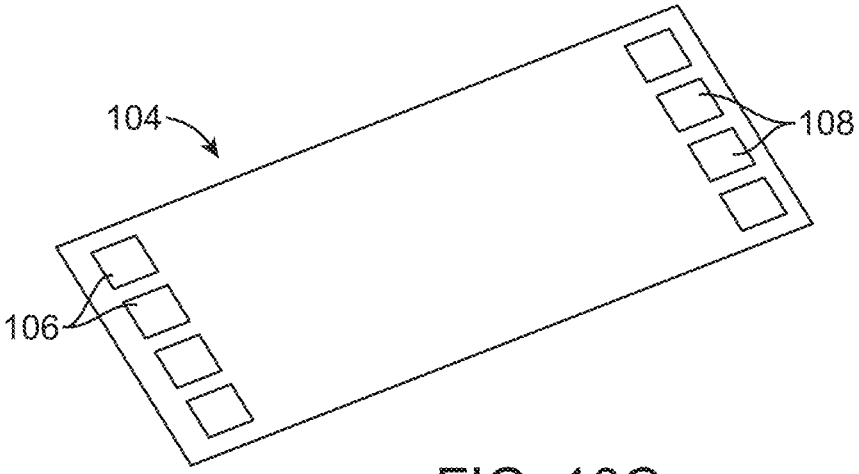
FIG. 10C shows a perspective view of another variation of the secondary support incorporating one or more pods along the support.

Yet another variation is shown in the perspective view of FIG. 10C which illustrates a secondary support 104 having one or more pods 106, 108 which may be filled with a fluid or gas or combination of both. The one or more pods 106, 108 may be filled individually with volume adjustability and they may be integrated within the secondary support 104 either near or at the ends of support 104, as shown, or anywhere else along the support 104 to help direct the fluid or gas in the areas of high pressure. Moreover, the one or more pods 106, 108 may be incorporated directly within the support 104 or they may be enclosed within a separate compartment or enclosure which may be attached separately to the support 104 or placed between the support 104 and underlying conforming support or any other combination.

The pods 106, 108 may generally be separated from one another such that no fluid communication occurs between the pods or with the secondary support 104 and each of the pods may be filled with the fluid or gas or both as described above. Although in alternative variations, some fluid communication may be provided between one or more of the pods. Additionally, the one or more pods may each occupy an envelope of, e.g., 1 cm×1 cm×0.5 cm to about 3 cm×3 cm×3 cm, in an uncompressed state and they may be formed into various shapes, e.g., spherical, cylindrical, cubical, etc. Moreover, each of the pods may be formed from various materials such as polyurethane, silicone, vinyl, nylon, polyethylene vinyl acetate (PEVA), etc. having a thickness ranging from, e.g., 0.1 mm to 5 mm. Although the figure illustrates four pods on either side of the secondary support 104, any number of pods may be utilized, e.g., 1 to 30 or more, arranged either uniformly or arbitrarily. Additional details are shown and described in further detail in the U.S. patent applications incorporated hereinabove.

Figure 11:
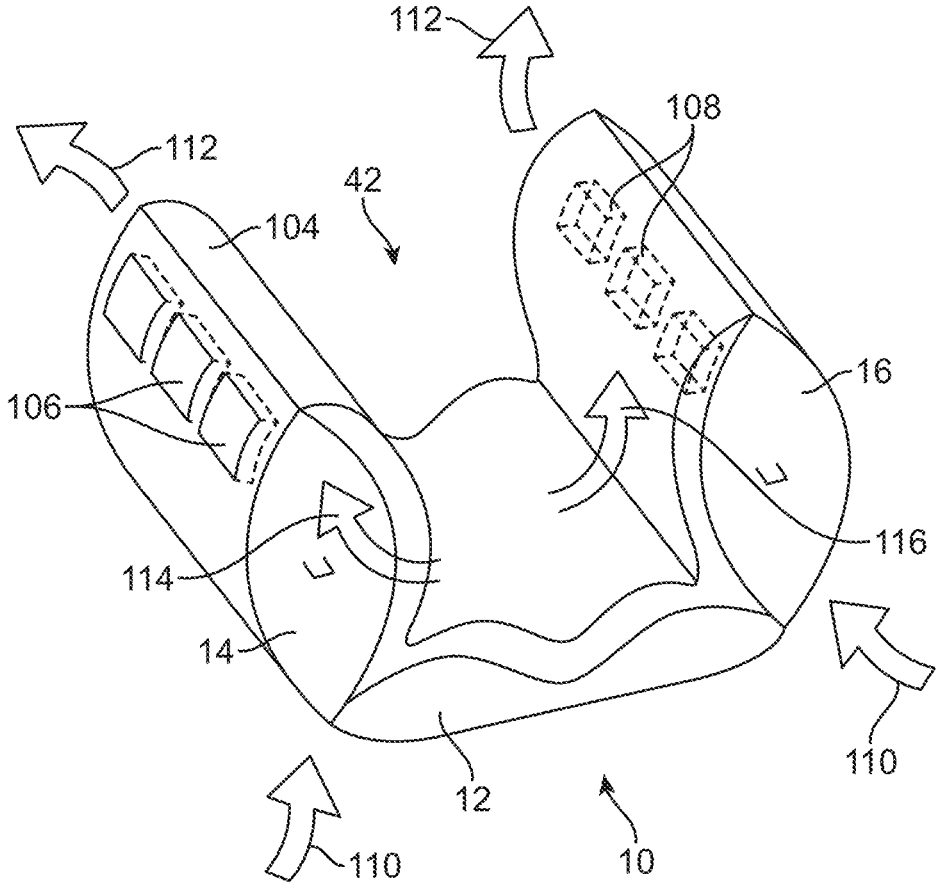
FIG. 11 shows a perspective view of a conforming support having a secondary support positioned upon the conforming support.

FIG. 11 shows a perspective view of a conforming support assembly having the secondary support 104 positioned atop the conforming support 10 and the one or more pods 106, 108 positioned either between the supports 10, 104 or integrated with one or both supports 10, 104. The secondary support 104 as well as the one or more pods 106, 108 may be secured or attached to the conforming support 10 through any number of mechanisms (e.g., hook-and-loop fasteners, clasps, etc.) to ensure that the supports do not move relative to one another beneath the patient body. When the patient lies upon the support assembly, the side portions 14, 16 and ends of the secondary support 104 (as well as the one or more pods 106, 108) may reconfigure from their flattened configuration into the conforming configuration where the side portions 14, 16 move into supporting contact against the sides of the patient body, as described above. Also shown are examples of how the fluid or gas may be inflated 110 into the assembly and/or deflated 112 (either before or during use by the patient) to adjust the assembly if so desired. Furthermore, with the secondary support 104 (as well as the one or more pods 106, 108) positioned relative to the conforming support 10, the transferred pressure 114, 116 of the fluid or gas are illustrated showing how the fluid or gas may be transferred from the central portion of the entire assembly to the sides of the assembly facilitating the reconfiguration of the support.

Figure 12A:
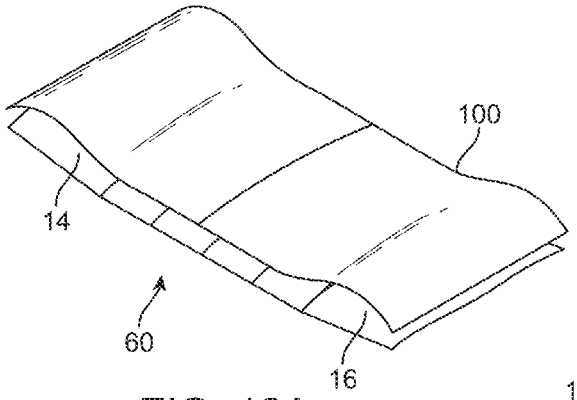
FIGS. 12A and 12B show perspective and end views of a conforming support variation having a secondary support positioned upon the conforming support.
Figure 12B:
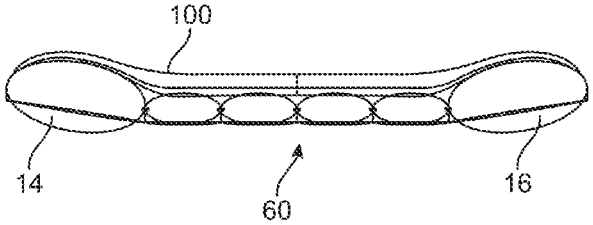
Figure 13A:
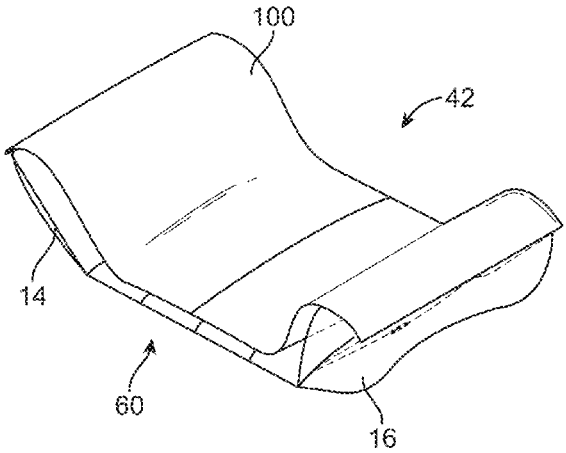
FIGS. 13A and 13B show perspective and end views of the conforming support and secondary support reconfigured into its supportive configuration.
Figure 13B:
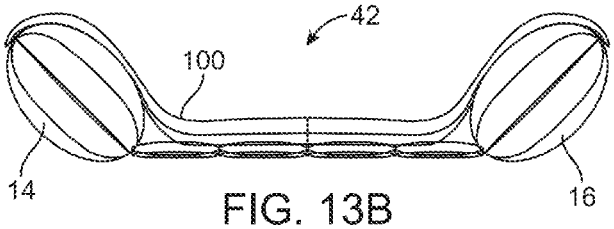
Figure 14A:
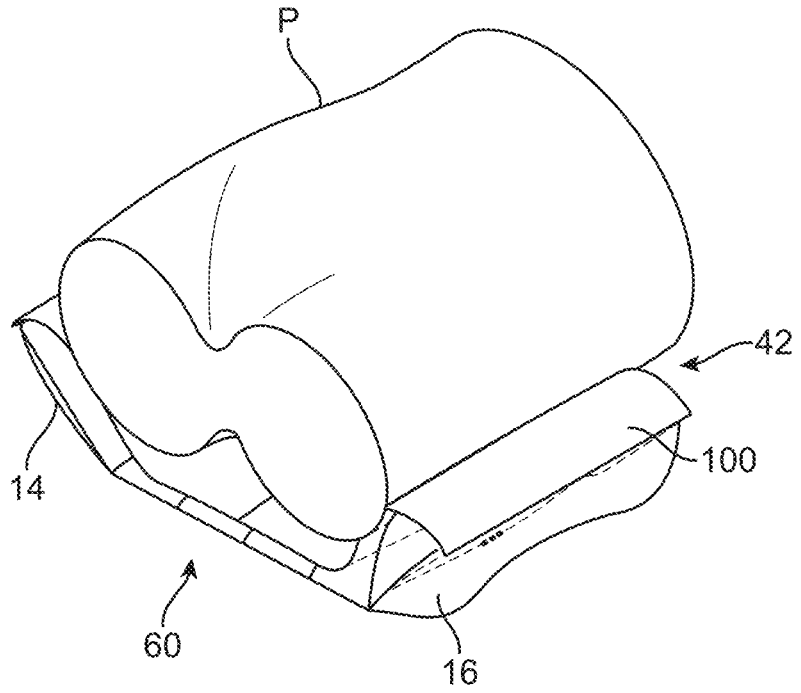
FIGS. 14A and 14B show perspective and end views of the conforming support and secondary support conforming against the patient body.
Figure 14B:
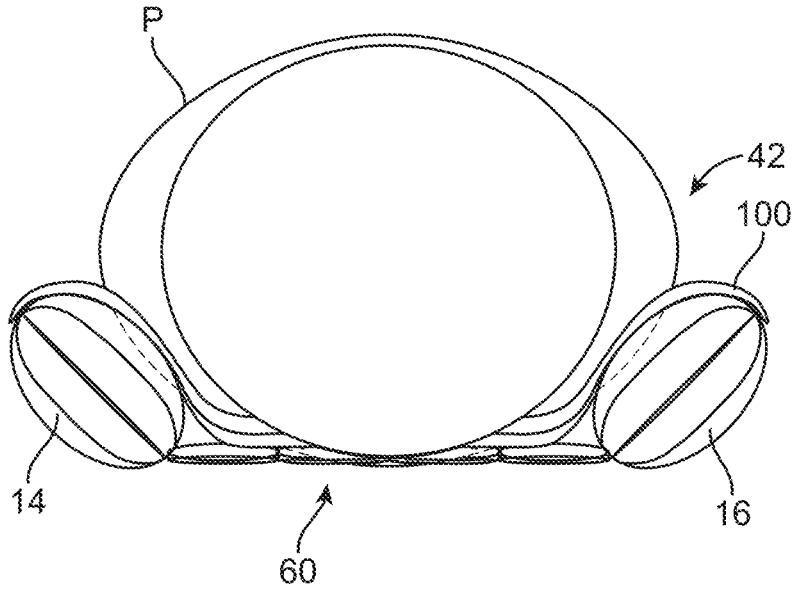

FIGS. 12A and 12B show perspective and end views of another variation of the secondary support 100 positioned upon the underlying conforming support having the segmented central portion 60. As described above, the secondary support 100 may be secured to the underlying conforming support. Moreover, the reconfigured assembly is shown in its supportive configuration in the perspective and end views of FIGS. 13A and 13B where the side portions 14, 16 are urged into their conforming configuration. Although the pods are not shown, they may be optionally integrated into this or any of the other assemblies described herein as well if so desired. FIGS. 14A and 14B show perspective and end views of an example where the patient body P is placed upon the central portion 60 and the secondary support 100. FIG. 14B further illustrates how the side portions 14, 16 may urge the secondary support 100 into supporting contact against the sides of the patient body.

Figure 15A:
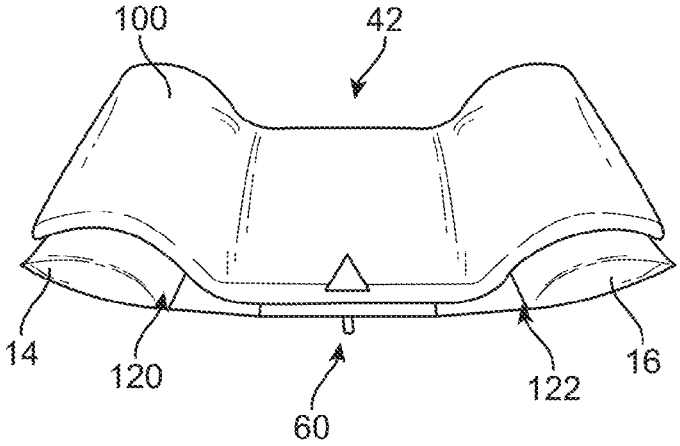
Figure 15B:
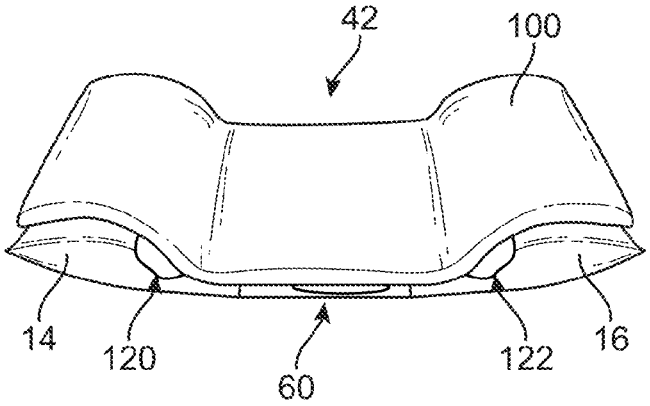
Figure 15C:
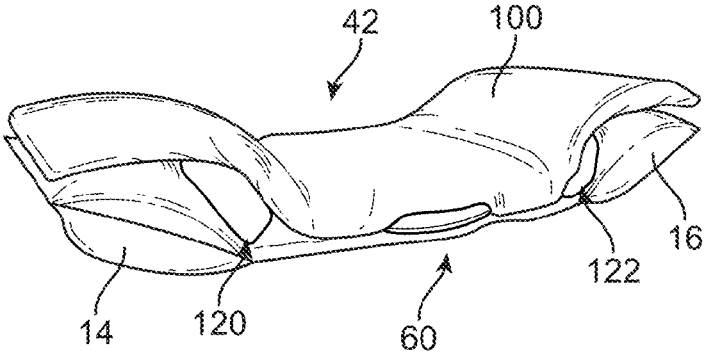

FIGS. 15A to 15C show perspective views of yet another variation of the support assembly where the one or more pods 120, 122 (which may be encased within a separate compartment or liner) may be positioned between the secondary support 100 and the underlying conforming support having the central portion 60 comprised of segmented sub-chambers. In this variation, the secondary support 100 may be fluid-filled (e.g., water) while the underlying conforming support may be filled with a gas (e.g., air). The one or more pods 120, 122 (e.g., one or more aligned serially) are shown positioned between the secondary support 100 and the conforming support such that the pods 120, 122 are positioned along the side portions 14, 16 for placement against the patient body when the support assembly is reconfigured into its supporting configuration.

Figure 16A:
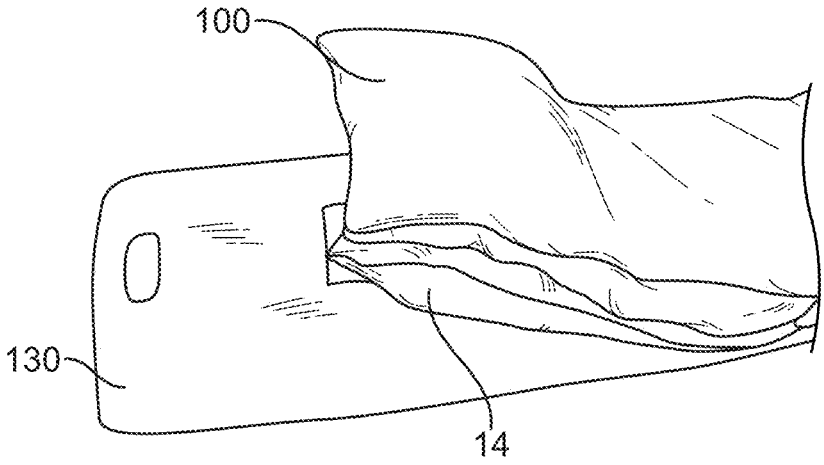
FIGS. 16A to 16C show perspective views of another variation of a secondary support positioned upon a conforming support.
Figure 16B:
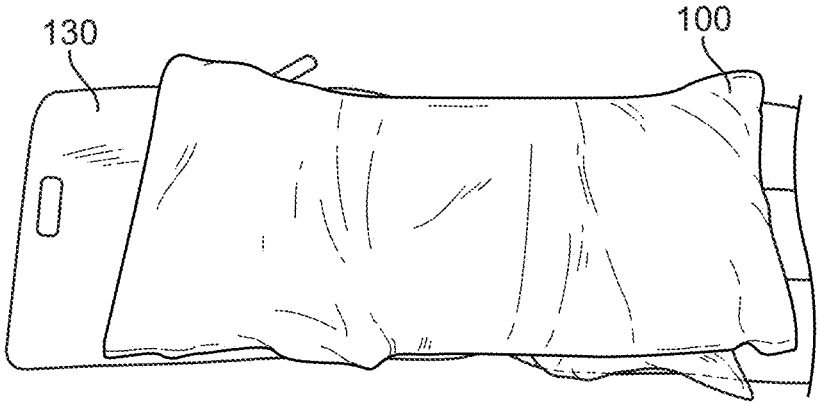
Figure 16C:
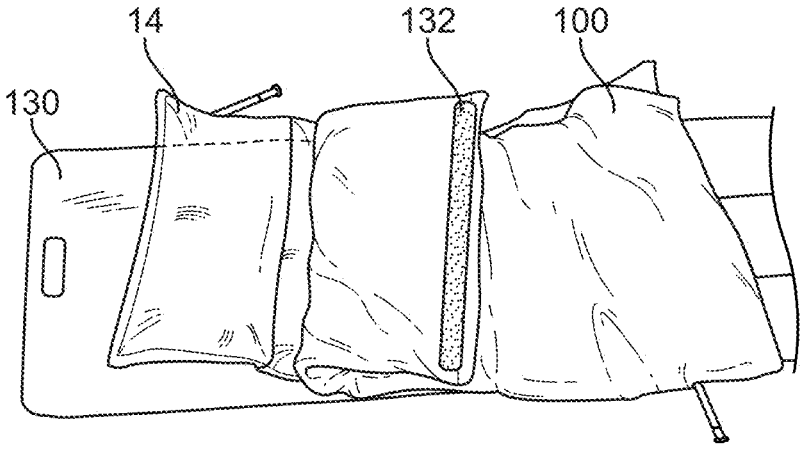

FIGS. 16A to 16C show perspective assembly views of another variation where the secondary support 100 may be enveloped by a covering which may include an attachment 132 (e.g., hook-and-loop fasteners) for securement to a support layer 130 which may be comprised of a fabric layer (which may be non-stretching). The covering may also include micro-climate management layers (e.g. thinsulate, primaloft or similar insulating fabrics). Moreover, the covering and secondary support 100 may be optionally attached (removably or permanently) along the entire length of the support layer 130.

Figure 17A:
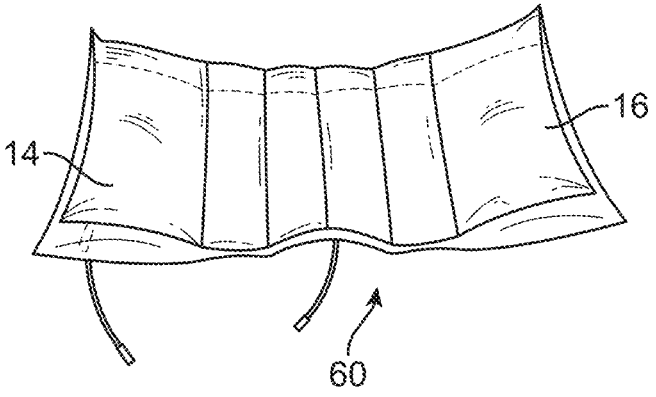
FIG. 17A shows a perspective view of one variation of the conforming support.
Figure 17B:
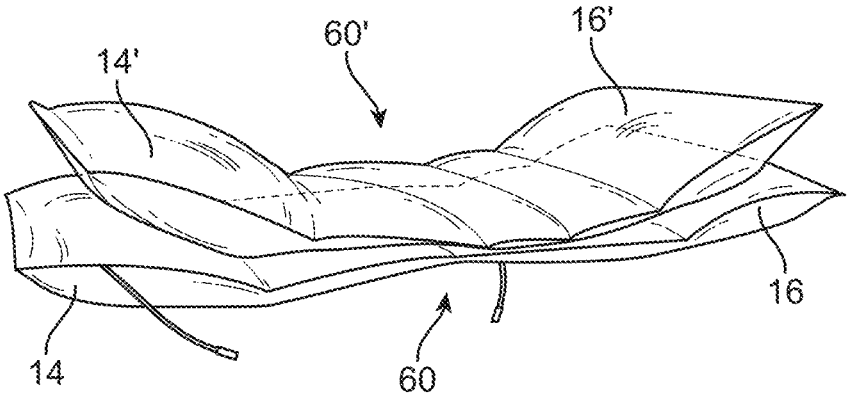
FIGS. 17B and 17C show perspective views of the first conforming support having a second conforming support positioned upon the first conforming support.
Figure 17C:
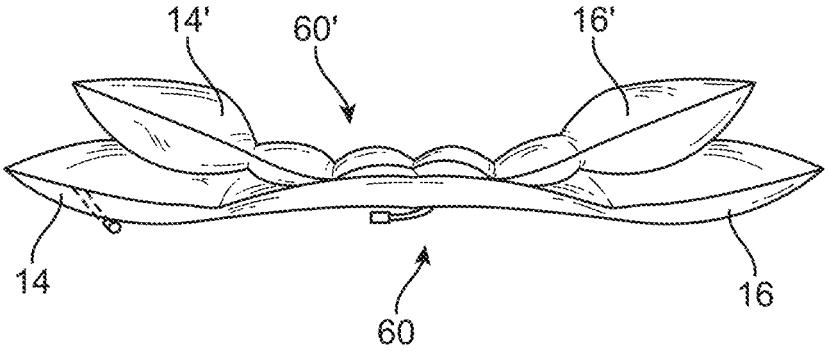

FIG. 17A shows an example of a first conforming support having a segmented central portion 60 placed upon a supporting platform. FIGS. 17B and 17C illustrate a second conforming support having a similarly segmented central portion 60' and respective first and second adjustable side portions 14', 16' which may be positioned upon or otherwise secured to the first confirming support to result in a combination conforming support assembly.

The various combinations of conforming supports and secondary supports may include any number of other combinations between the different types of support as well as the different fluids and/or gases which may be used for inflating the supports but which may not be shown. Such various combinations are intended to be within the scope of this description.

Figure 18A:
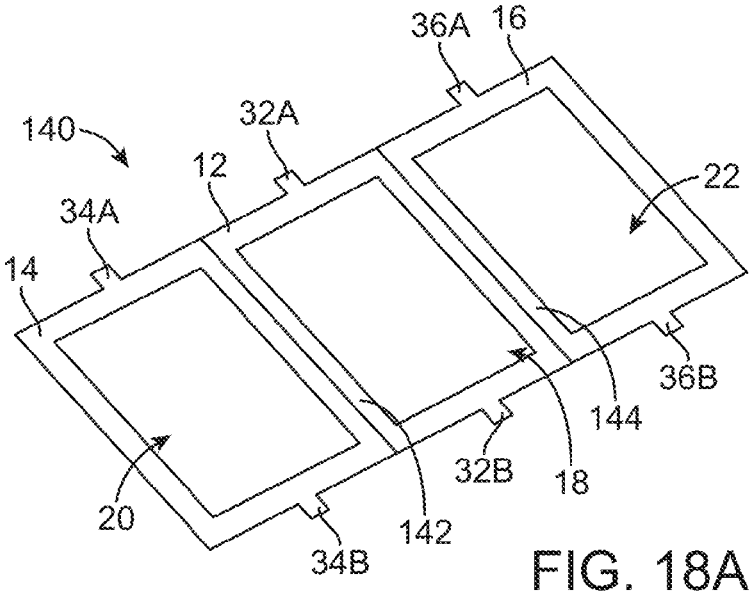
FIG. 18A shows a perspective view of yet another variation of a conforming support where each of the chambers is fluidly isolated from one another.

While the various supports described having incorporated conforming support structures have fluidly coupled chambers to provide for fluid transfer between the different chambers, FIG. 18A shows a perspective view of another variation of a conforming support 140 where each portion defines a chamber which is fluidly isolated from one another. The conforming support 140 is shown in a flattened configuration having a central portion 12 which defines a central chamber 18, a first adjustable side portion 14 which defines a first side chamber 20, and a second adjustable side portion 16 which defines a second side chamber 22 similar to embodiments described above. However, respective barriers 142, 144 separate each of the chambers from one another to fluidly isolate the chambers. Each of the chambers 18, 20, 22 may be at least partially inflated and/or deflated prior to or during use through their respective ports with any of the fluids and/or gases, as previously described, to ensure that the patient is adequately supported and does not contact the underlying platform or surface.

When a load is applied upon the central portion 12 such as when the patient lies upon or places a portion of their body upon the support, the side portions 14, 16 may be individually adjusted by further inflating and/or deflating their respective chambers to ensure that the side portions 14, 16 are able to angle and lift against the underlying platform or surface relative to the central portion 12. Moreover, because the internal pressure of each of the portions need not be uniform, they may be individually adjusted to accommodate different patient body types or to induce tilting of the patient to their side.

Alternative variations may incorporate a pump to actively inflate and/or deflate one or more the portions individually or simultaneously to induce motion and relieve contact pressure. Moreover, other variations may have different configurations of partially or fully filled and unfilled portions, e.g., filled central portion with unfilled side portions or unfilled central portion with filled side portions, etc.

Figure 18B:
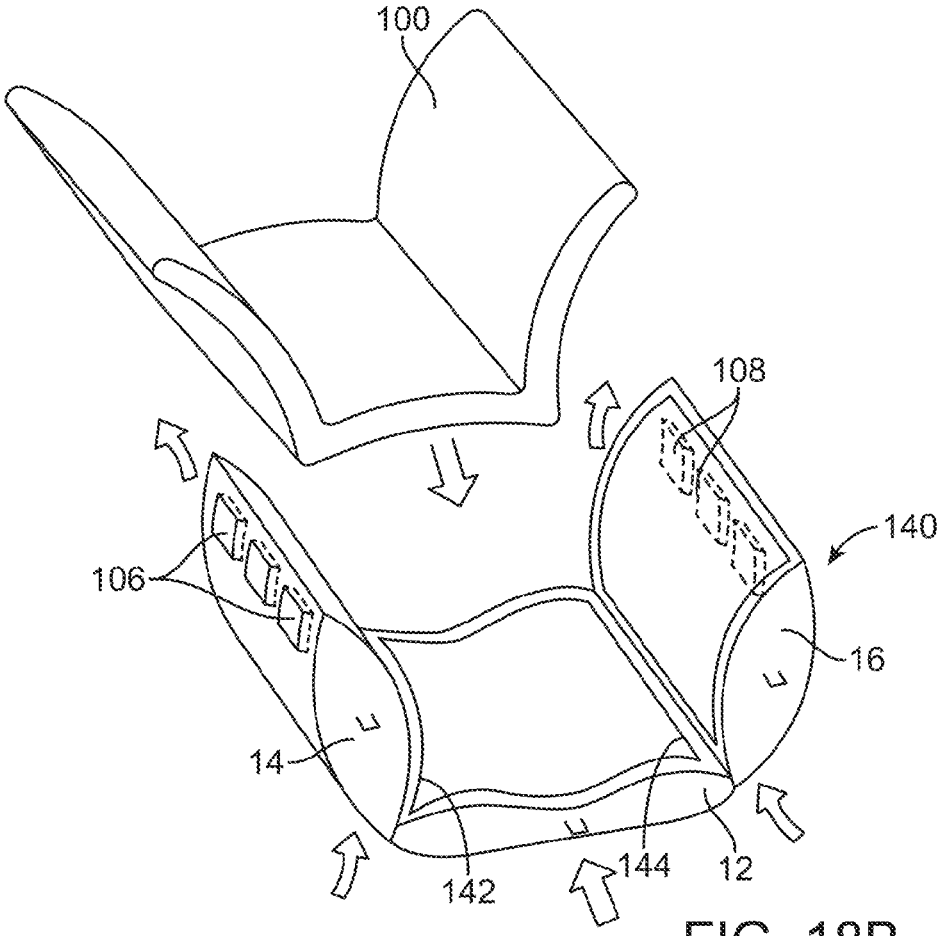
FIG. 18B shows a perspective assembly view of the conforming support of FIG. 18A having a secondary support positioned upon the conforming support.

The fluidly disconnected conforming system may be similarly combined with any of the secondary supports as well. FIG. 18B shows a perspective assembly view of one variation of the disconnected conforming support 140 incorporated with secondary support 100. Additionally and/or alternatively, one or more pods 106, 108 may be optionally incorporated with, between, along, etc. with the conforming support 140 and secondary support 100 in any of the variations described above. Because each of the portions 12, 14, 16 are fluidly isolated from one another, each of the respective chambers may be at least partially inflated and/or deflated through each of their respective ports. Even though the portions 12, 14, 16 are fluidly separated, one or both of the side portions 14, 16 may still reconfigure automatically and rise when the patient places weight upon the central portion 12 due to the relative differences in volume and/or pressure within the side portions 14, 16 relative to the volume and/or pressure within the central portion 12.

Figure 19A:
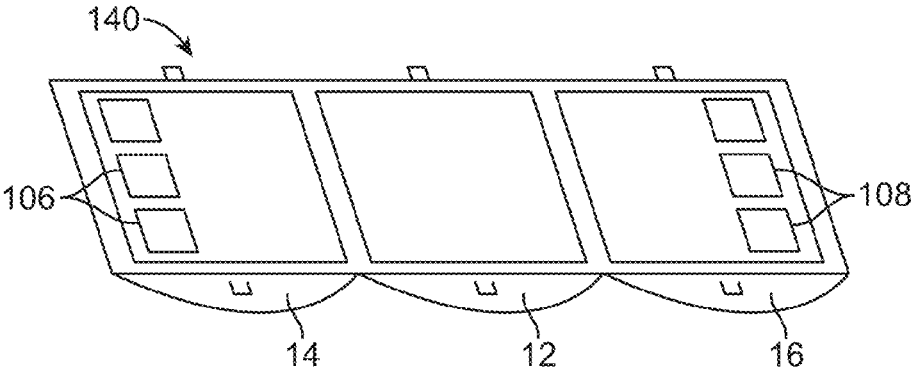
FIGS. 19A to 19C show yet another variation of the conforming support having a secondary support along with one or more pods and the reconfiguration that the support undergoes when a patient body is placed upon the supports.
Figure 19B:
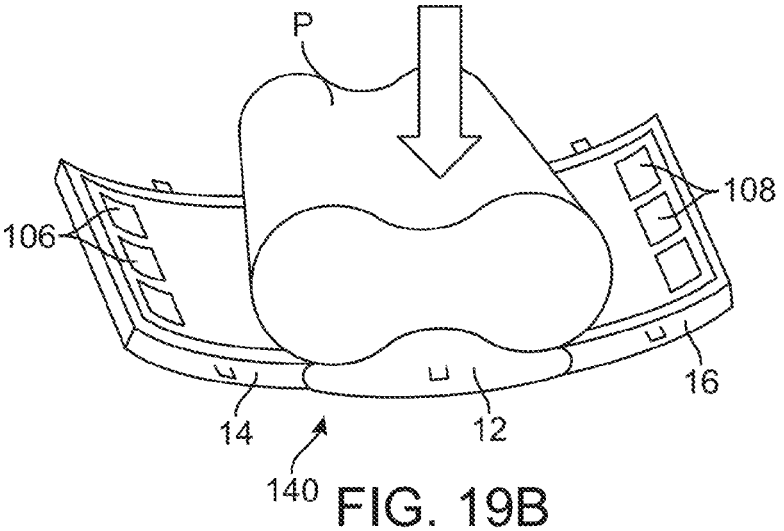
Figure 19C:
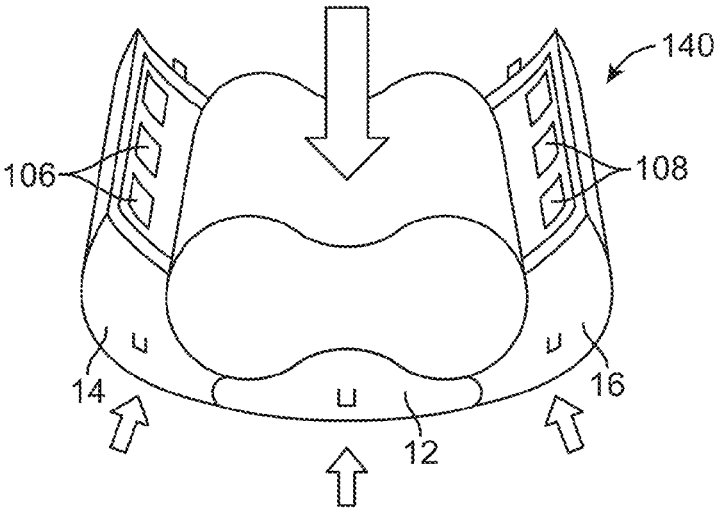

An example is illustrated in the perspective views of FIGS. 19A to 19C which show a disconnected conforming support 140 having optional pods 106, 108 incorporated along the ends of the side portions 14, 16. As the patient P lies upon the central portion 12, as shown in FIG. 19B, the central portion 12 may compress under the weight of the patient P yet due to the relative difference in volume and/or pressure between the central portion 12 and side portions 14, 16, the outer surfaces of the side portions 14, 16 may react against the underlying platform or surface. As the central portion 12 decreases in height, the side portions 14, 16 may be urged or otherwise forced to angle into direct contact against the sides of the patient body P, as shown in FIG. 19C, such that the side portions 14, 16 provide support while they conform to the anatomy of the patient.

Figure 20A:
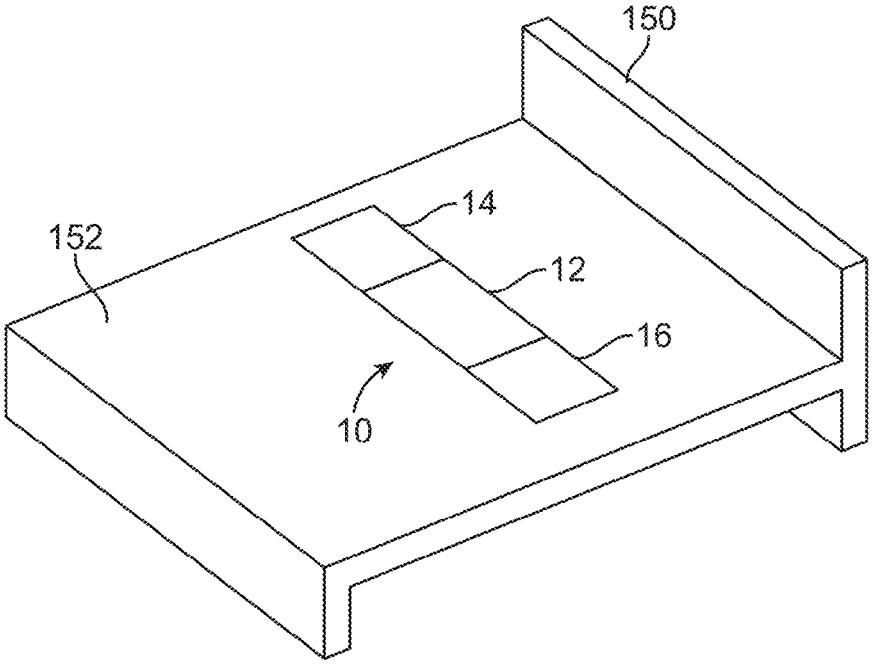
FIGS. 20A and 20B show perspective views illustrating how the conforming support may be positioned upon a bed or otherwise integrated with a mattress.
Figure 20B:
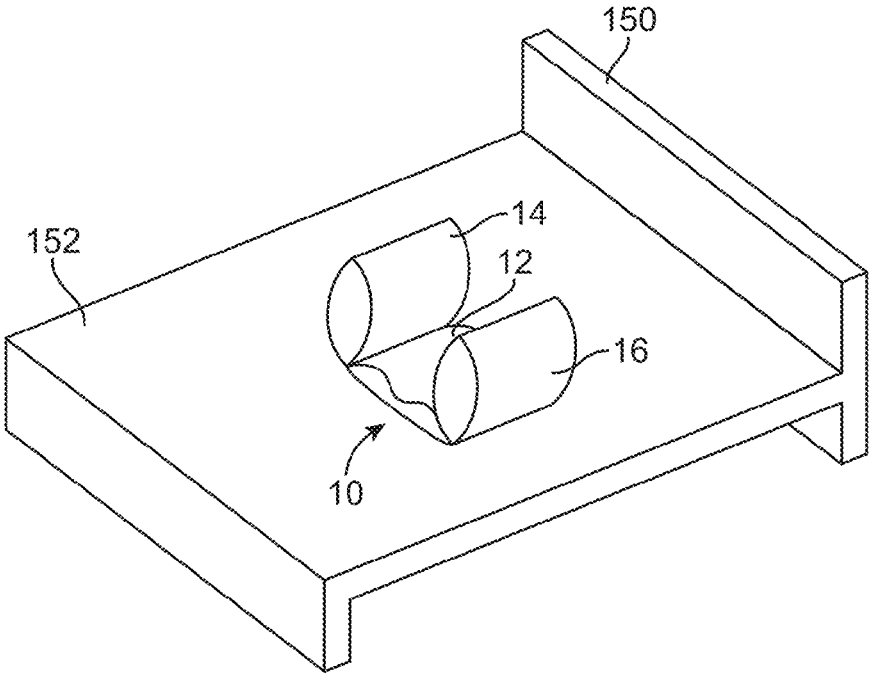

Regardless of which variation is utilized, any of the conforming supports and/or support assemblies may be incorporated with other active or non-active support surfaces, e.g., beds, mattresses, wheelchairs, seats, etc., and perform with the same functionality. One variation is shown in the perspective views of FIGS. 20A and 20B which illustrate a conforming support 10 laid out in its flattened configuration upon mattress 152 of platform 150 (e.g., bed, cot, etc.). The conforming support 10 may be positioned or otherwise secured upon the mattress 152 beneath any portion of the patient body to be supported (e.g., hips). As the patient lies upon both the conforming support 10 and mattress 152, the side portions 14, 16 may react against the surface of the mattress 152 to reconfigure into its supporting configuration, as shown in FIG. 20B.

Figure 21A:
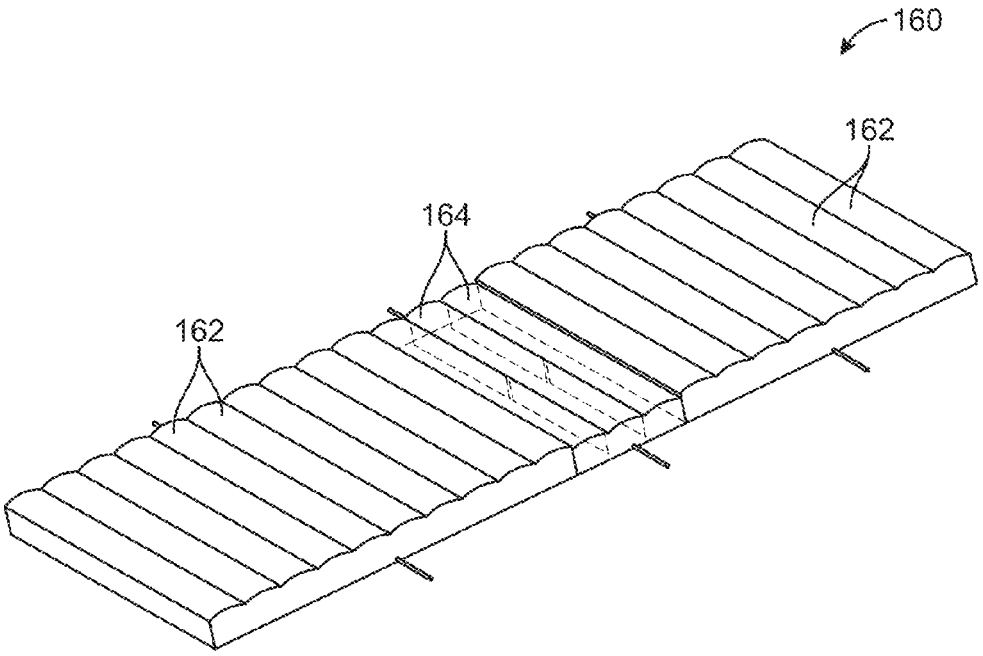
FIGS. 21A to 21C show perspective views of a mattress having one or more chambers and a conforming support assembly positioned upon or otherwise integrated with the mattress.
Figure 21B:
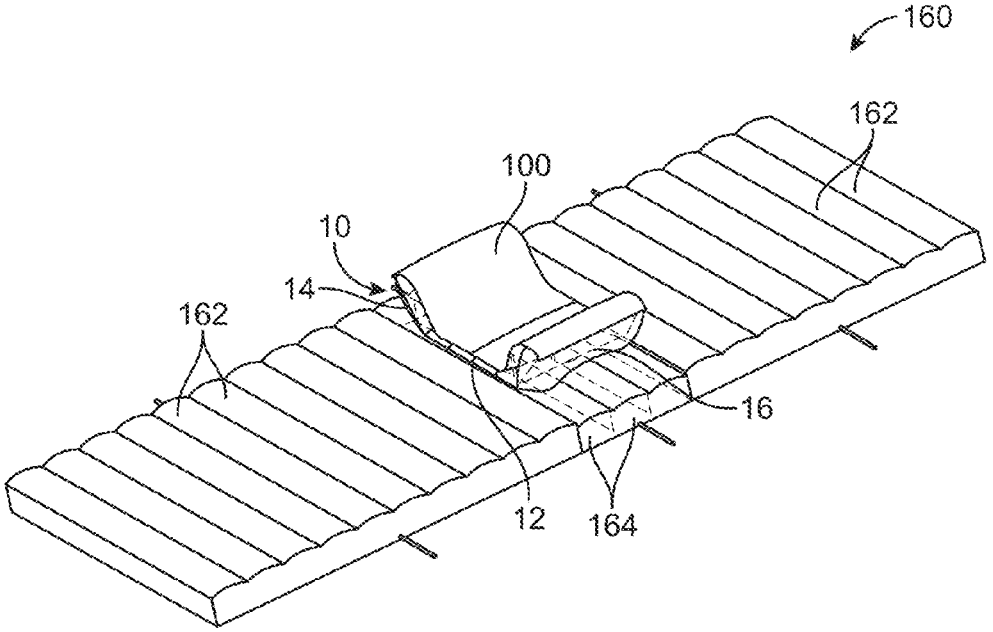
Figure 21C:
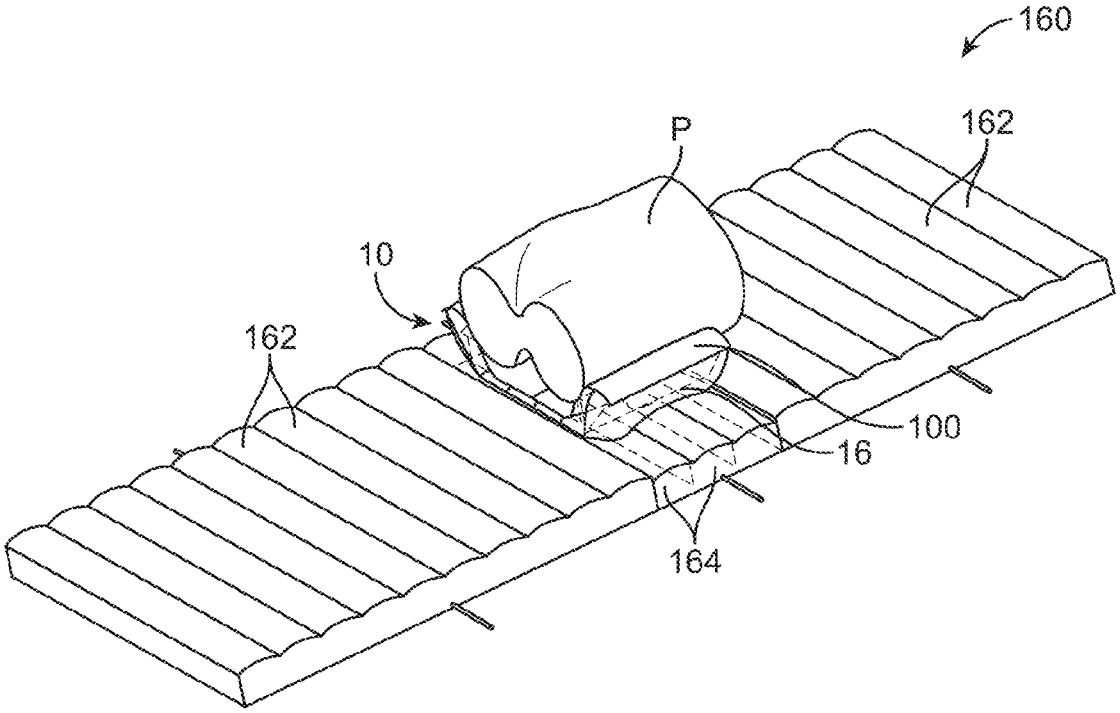

In yet another variation, FIGS. 21A to 21C illustrate how the conforming support assembly may be positioned upon a platform or mattress 160 which may also be configured with a plurality of baffles or individual chambers 162 as well. The mattress 160 is shown with individual chambers 162 oriented to align across the width of the mattress 160. While the chambers 162 may be incorporated along the entire length of the mattress 160, the chambers 162 may be optionally incorporated only along portions of the mattress 160 such as where the portion of the patient body is to be additionally supported, e.g., where the hips or head of the patient may rest. As further shown, partial internal views of chambers 164 are shown to illustrate how the chambers 164 may incorporate barriers along the lengths of the chambers which may be each fluidly coupled or isolated relative to one another.

FIG. 21B illustrates how the conforming support assembly (incorporating a secondary support such as support 100) may be positioned upon the mattress 160 to reside where the hips of the patient may rest. The conforming support assembly may be secured (using any number of securement mechanisms) to the underlying mattress 160 or the support assembly may simply rest upon the surface of the mattress. In either case, once the patient body P is placed upon the conforming support assembly, as shown in FIG. 21C, the support assembly may provide for conforming support, as described herein. The underlying chambers 162 of mattress 160 may provide for additional support in a direction transverse to the support assembly not only directly beneath the support assembly but along the entire patient body.

Figure 22A:
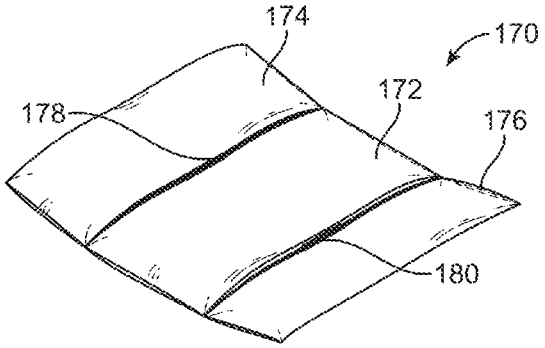
FIGS. 22A and 22B show perspective and end views of another variation of the conforming support which is sized for supporting the head of a patient.
Figure 22B:
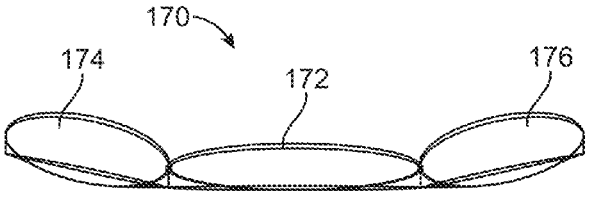
Figure 23A:
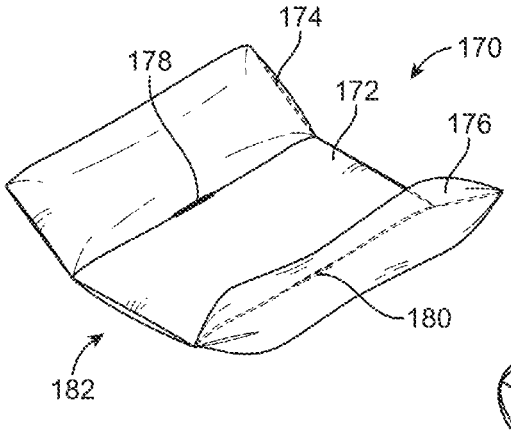
FIGS. 23A and 23B show perspective and end views of the conforming support of FIG. 22A in its conforming supportive configuration.
Figure 23B:
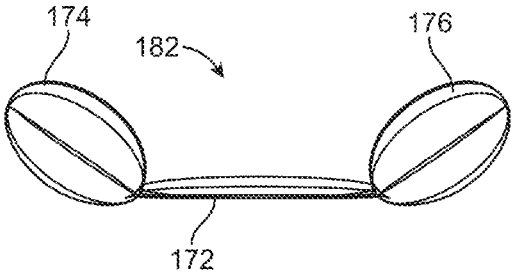

In other variations of the conforming support assembly, the support may be configured and sized to support any other region of the patient's body. One variation is shown in the perspective and end views of FIGS. 22A and 22B of a conforming support 170 which is sized for the head of the patient. Functionally similar to the variations described hereinabove, the conforming support 170 may include a central portion 172, a first adjustable side portion 174 and a second adjustable side portion 176 which are each in fluid communication with one another via respective interconnecting channels 178, 180. As shown in the perspective and end views of FIGS. 23A and 23B, when the patient places their head upon the central portion 172, a conforming channel 182 may be formed as the side portions 174, 176 raise up and angle relative to the central portion 172 into a supportive configuration against the sides of the patient's head.

Figure 24A:
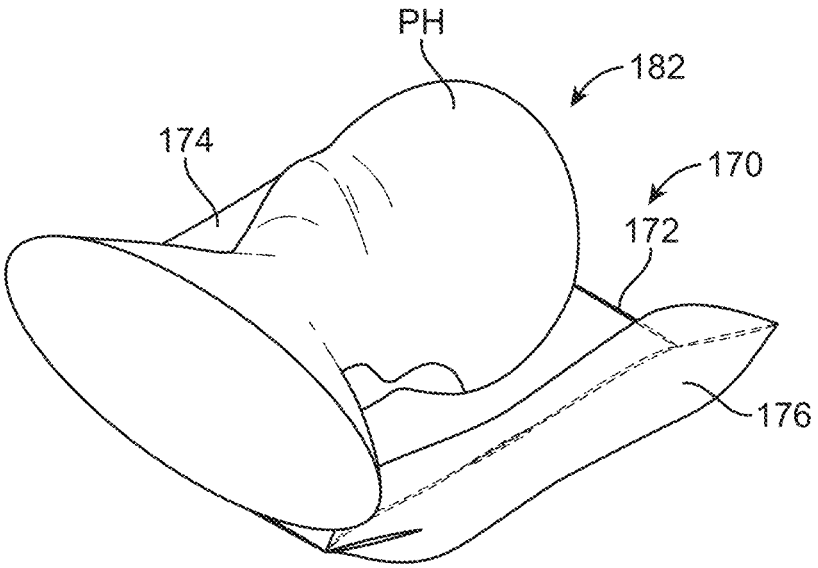
FIGS. 24A and 24B show perspective and end views of the conforming support with the patient's head placed upon the support.
Figure 24B:
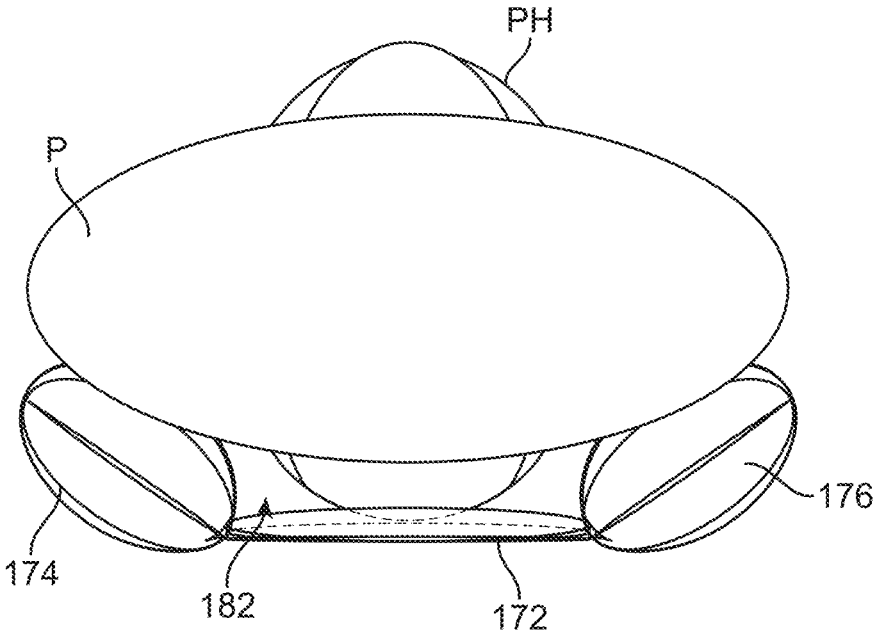
Figure 25A:
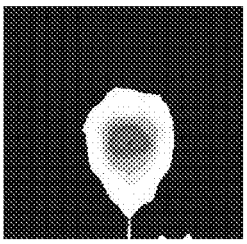
FIGS. 25A to 25D show pressure maps for comparison of the resulting pressure distribution when various supports are used to support a patient's head.
Figure 25B:
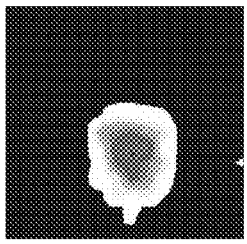
Figure 25C:
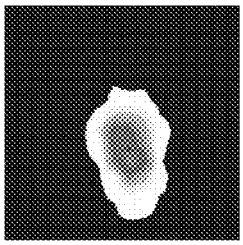
Figure 25D:
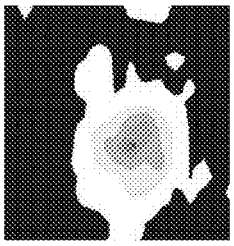
Figure 26A:
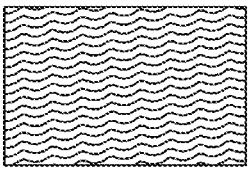
FIGS. 26A to 26D show the corresponding types of supports used in creating the pressure maps.
Figure 26B:
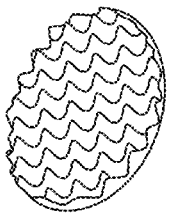
Figure 26C:
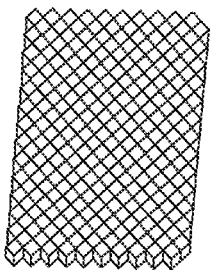
Figure 26D:
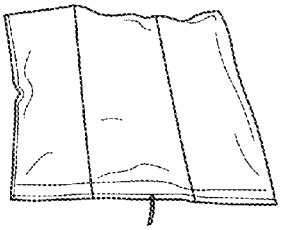

FIGS. 24A and 24B show perspective and end views of an exemplary patient's head PH resting upon the central portion 172. The side portions 174, 176 may accordingly raise up into contact against the sides of the patient's head PH within the conforming channel 182 formed by the portions. Because the conforming support 170 is sized for the patient's head, the dimensions of the support are scaled accordingly. For instance, the overall thickness of the support 17 when unloaded may range from at least, e.g., 0.25 inches, and a length of the support 170 may range up to, e.g., 12 inches, with an overall width of up to, e.g., 12 inches as well. The side portions 174, 176 as well as central portion 172 may be each sized to each have a width of, e.g., 2 inches or greater, and the overall volume of the support 170 may range anywhere up to, e.g., 5 liters, of fluid or gas. The width of the interconnecting channels 178, 180 may also be varied to control the rate at which the fluid or gas passes through and may accordingly range, e.g., greater than 0.5 inches in width. This may provide for a conforming angle of anywhere from, e.g., 0 to 25 degrees or greater, between the side portions 174, 176 and the central portion 172 when the patient's head PH is resting upon the central portion 172.

To compare the supportive effects of the conforming support, profiles of the resulting pressure distribution of an exemplary patient head PH was mapped using various supports, as shown in the pressure maps of FIGS. 25A to 25D. The corresponding type of support or cushioning is shown respectively in FIGS. 26A to 26D. As illustrated, a pressure map 190 of the patient head PH positioned upon a commercially available specialty gel mattress 192 is shown yielding a peak pressure of 74.78 mmHg. The pressure map 200 of the patient head PH positioned upon a commercially available Devon™ Disposable Foam 202 (Kendall Healthcare Products Co.) yielding a peak pressure of 81.54 mmHg. The pressure map 210 of the patient head PH positioned upon a commercially available gel matrix 212 yielding a peak pressure of 96.76 mmHg, and the pressure map 220 of the patient head PH positioned upon a conformable support 222 as described herein yielding a peak pressure of 49.22 mmHg.

Figure 27A:
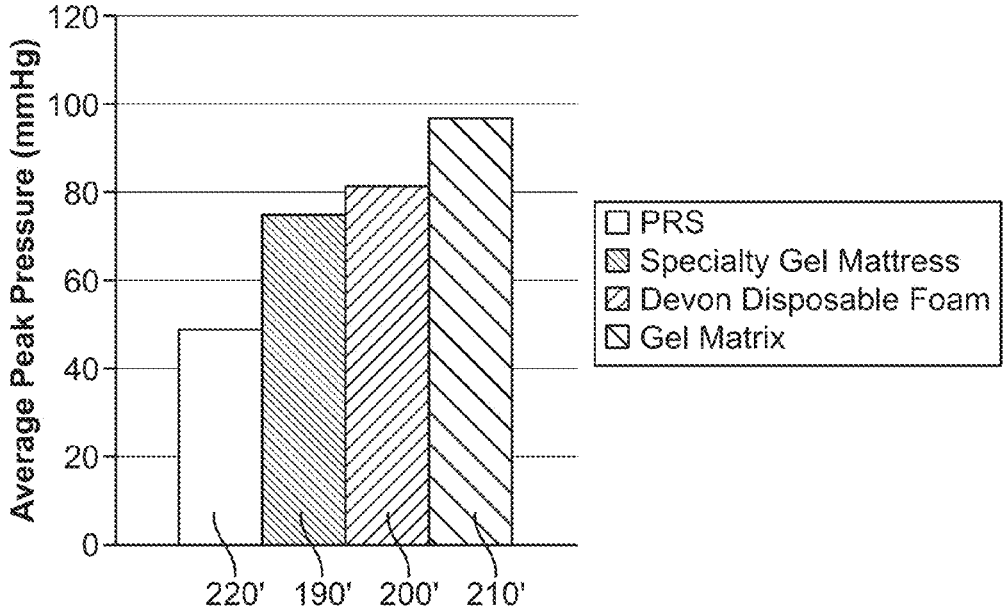
FIGS. 27A and 27B show graphs of the comparative average peak pressure corresponding to each of the various supports.
Figure 27B:
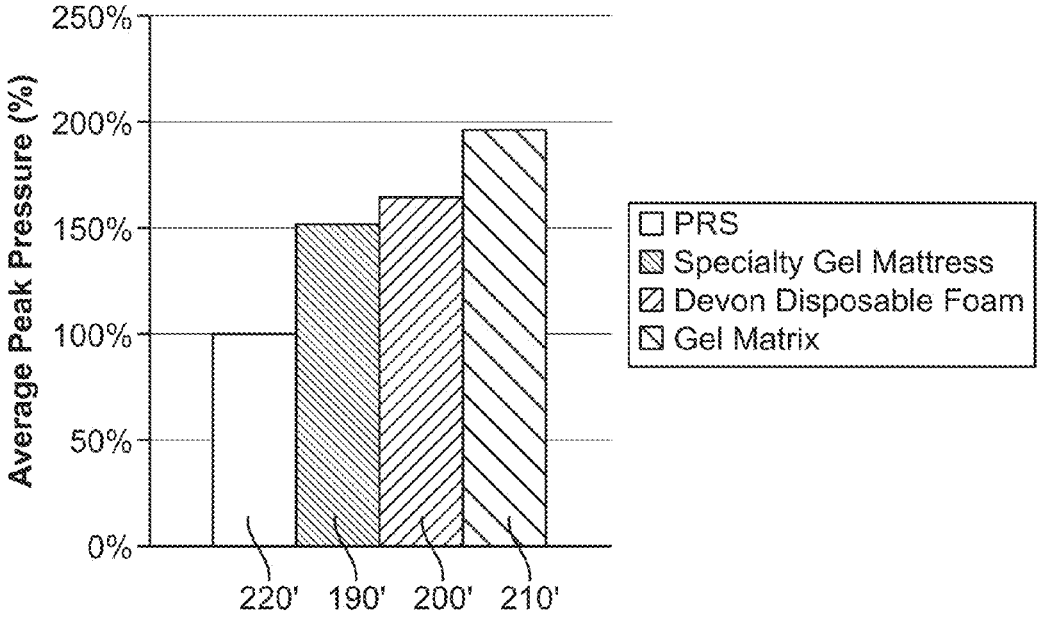

FIG. 27A illustrates a chart of the resulting measured (mmHg) average peak pressure and FIG. 27B illustrates a chart of the resulting percentage (%) average peak pressure of each of the different supports. As shown, the results of the average peak pressure 190' from the specialty gel mattress 192, the average peak pressure 200' from the Devon™ Disposable Foam 202, the average peak pressure 210' from the commercially available gel matrix 212, and the average peak pressure 220' from the conforming support 222 are illustrated for comparison. Accordingly, the resulting average peak pressure from the conforming support 220' on the patient head PH is significantly lower.

Figure 28A:
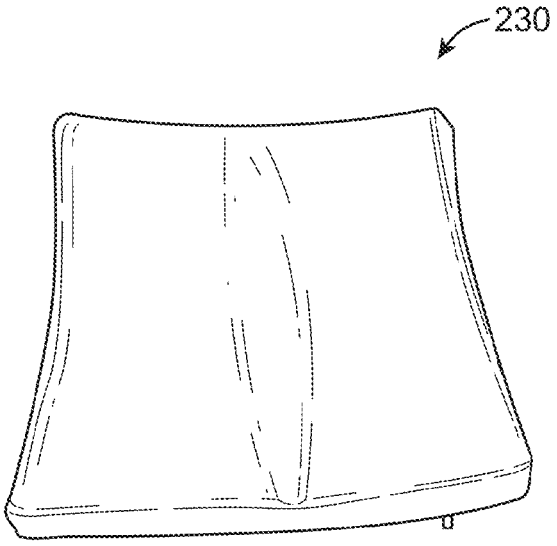
FIGS. 28A to 28C show various perspective views of another variation of a conforming support which is configured to support a patient's elbow.
Figure 28B:
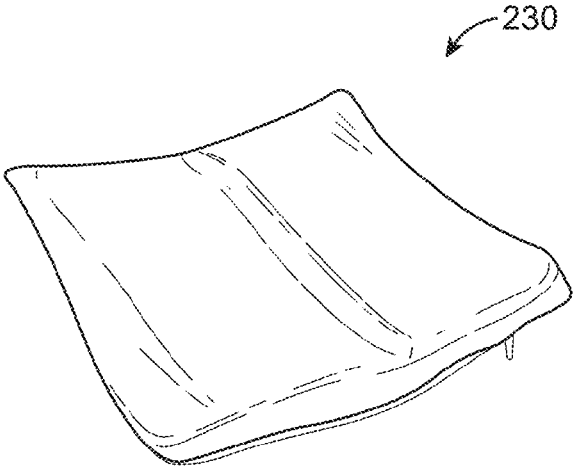
Figure 28C:
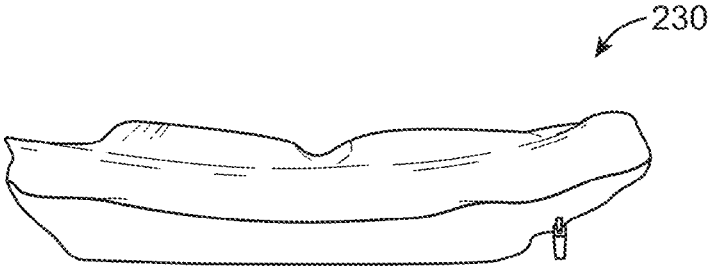
Figure 29A:
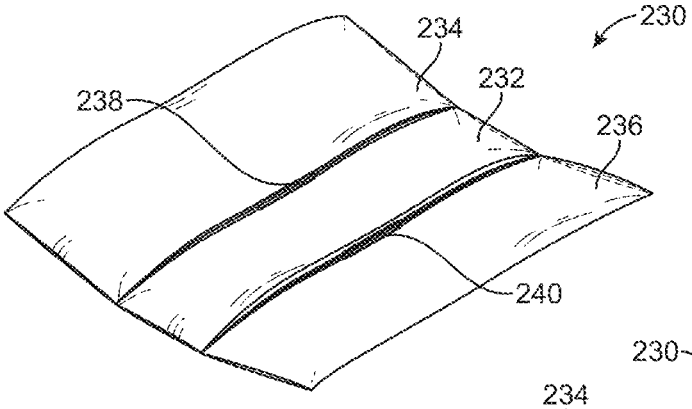
FIGS. 29A and 29B show perspective and end views of another variation of the conforming support which is sized for supporting the patient's elbow.
Figure 29B:
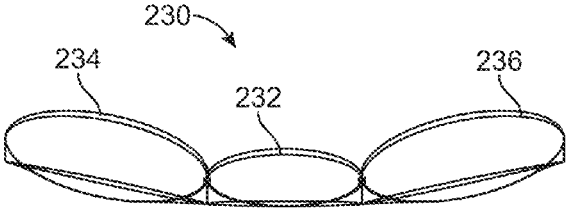
Figure 30A:
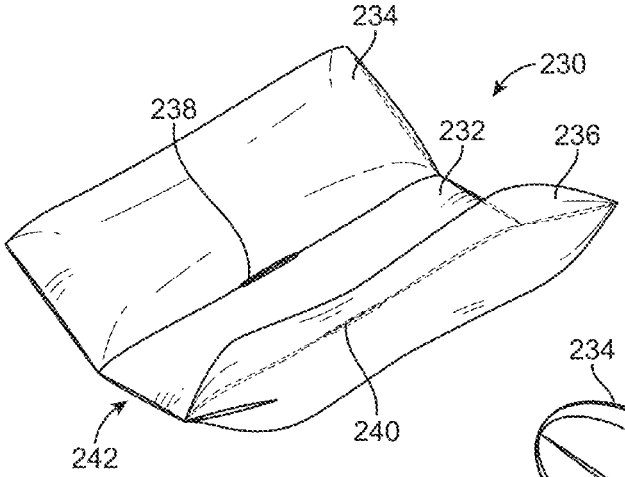
FIGS. 30A and 30B show perspective and end views of the conforming support of FIG. 29A in its conforming supportive configuration
Figure 30B:
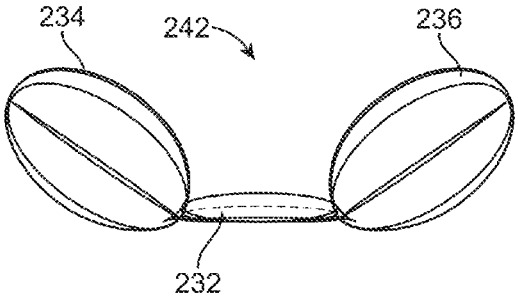

Another variation is shown in the perspective views of FIGS. 28A to 28C of a conforming support 230 which is sized for the elbow of the patient. Also, functionally similar to the variations described hereinabove, the conforming support 230 may include a central portion 232, a first adjustable side portion 234 and a second adjustable side portion 236 which are each in fluid communication with one another via respective interconnecting channels 238, 240, as shown in the perspective and end views of FIGS. 29A and 29B. When the patient places their elbow upon the central portion 232, a conforming channel 242 may be formed as the side portions 234, 236 raise up and angle relative to the central portion 232 into a supportive configuration against the sides of the patient's elbow, as shown in the perspective and end views of FIGS. 30A and 30B.

Figure 31A:
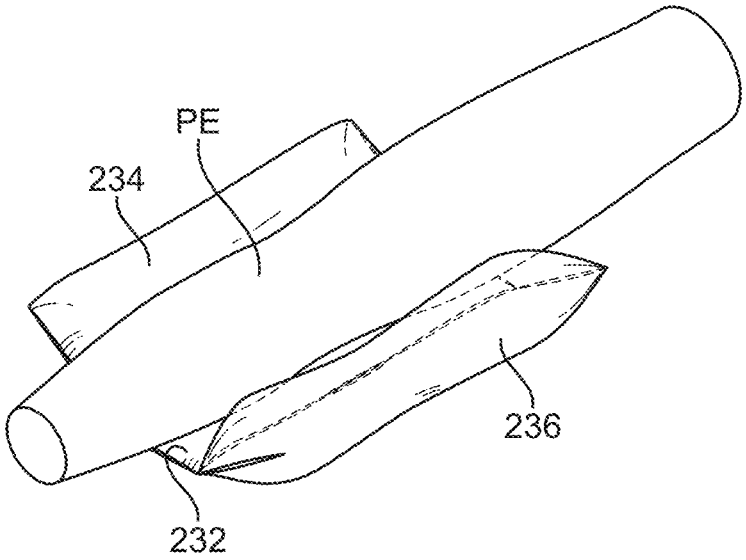
FIGS. 31A and 31B show perspective and end views of the conforming support with the patient's elbow placed upon the support.
Figure 31B:
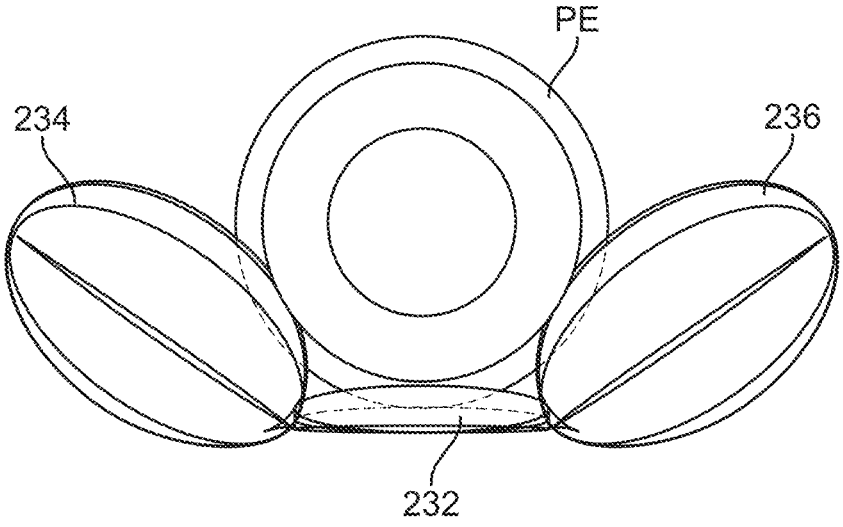
Figure 32A:
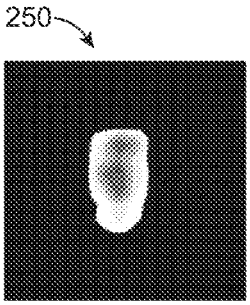
FIGS. 32A to 32D show pressure maps for comparison of the resulting pressure distribution when various supports are used to support a patient's elbow.
Figure 32B:
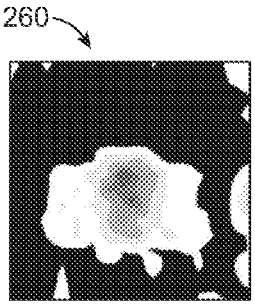
Figure 32C:
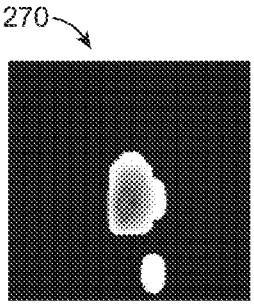
Figure 32D:
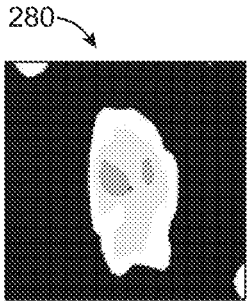

FIGS. 31A and 31B show perspective and end views of an exemplary patient's elbow PE resting upon the central portion 232. The side portions 234, 236 may accordingly raise up into contact against the sides of the patient's elbow PE within the conforming channel 242 formed by the portions. Because the conforming support 230 is sized for the patient's elbow, the dimensions of the support are scaled accordingly. For instance, the overall thickness of the support when unloaded may range from at least, e.g., 0.25 inches, and a length of the support 230 may range up to, e.g., 8 inches or more, with an overall width of up to, e.g., 6 inches or more. The side portions 234, 236 as well as central portion 232 may be each sized to each have a width of, e.g., 2 inches or greater, and the overall volume of the support 170 may range anywhere up to, e.g., 5 liters, of fluid or gas. The width of the interconnecting channels 238, 240 may also be varied to control the rate at which the fluid or gas passes through and may accordingly range, e.g., greater than 0.5 inches in width. This may provide for a conforming angle of anywhere from, e.g., 0 to 25 degrees or greater, between the side portions 234, 236 and the central portion 232 when the patient's elbow PE is resting upon the central portion 232.

Figure 33A:
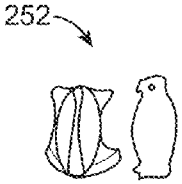
FIGS. 33A to 33D show the corresponding types of supports used in creating the pressure maps.
Figure 33B:
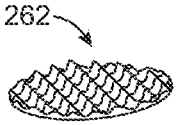
Figure 33C:
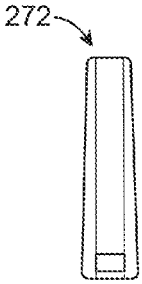
Figure 33D:
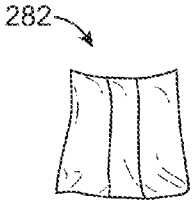
Figure 34A:
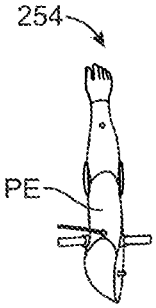
FIGS. 34A to 34D show the corresponding types of supports with an analog of the patient's elbow placed upon the corresponding support.
Figure 34B:
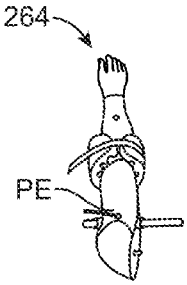
Figure 34C:
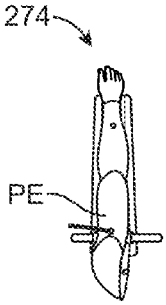
Figure 34D:
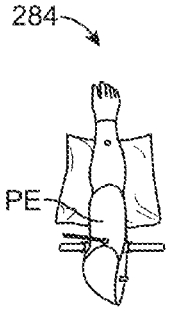

To compare the supportive effects of the conforming support, profiles of the resulting pressure distribution of an exemplary patient elbow PE was mapped using various supports, as shown in the pressure maps of FIGS. 32A to 32D. An elbow analog weighing about 4.5 kg was used to simulate a patient's elbow. The corresponding type of support or cushioning is shown respectively in FIGS. 33A to 33D and the support positioned around or beneath the elbow analog is further shown respectively in FIGS. 34A to 34D. As illustrated, a pressure map 250 in FIG. 32A of the patient elbow PE positioned upon a commercially available ProCare Mesh Elbow Protector 252 (DJO Global, LLC, Vista, Calif.) is shown in FIGS. 33A and 34A yielding a peak pressure of 84.77 mmHg. The pressure map 260 in FIG. 32B of the patient elbow PE positioned upon a commercially available Devon™ Ulnar Nerve Protector 262 (Kendall Healthcare Products Co.) is shown in FIGS. 33B and 34B yielding a peak pressure of 64.95 mmHg. The pressure map 270 in FIG. 32C of the patient elbow PE positioned upon a commercially available Devon™ Gel Pad Arm Board 272 is shown in FIGS. 33C and 34C yielding a peak pressure of 106.71 mmHg, and the pressure map 280 in FIG. 32D of the patient elbow PE positioned upon a conformable support 282 is shown in FIGS. 33D and 34D as described herein yielding a peak pressure of 32.28 mmHg.

Figure 35A:
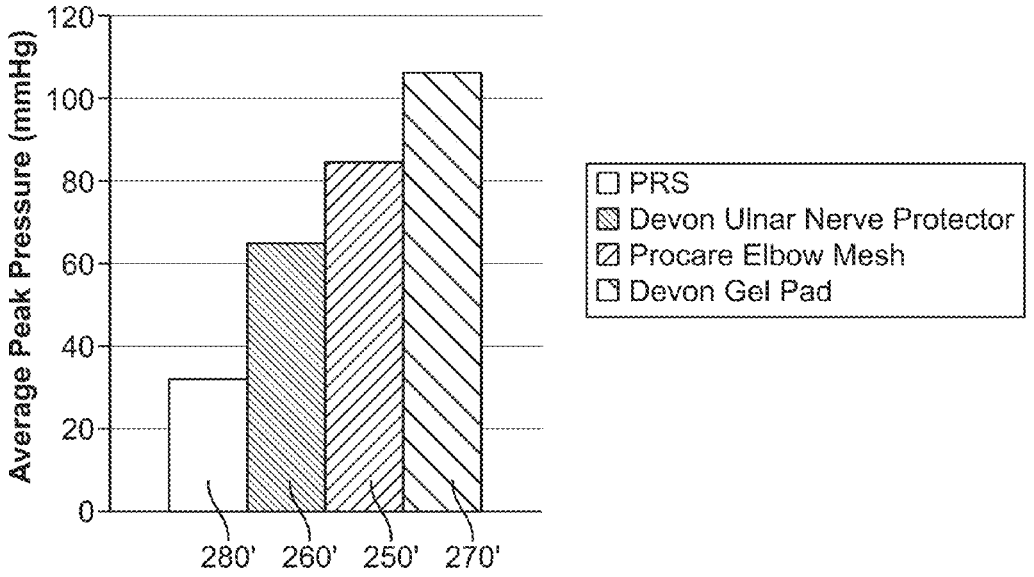
FIGS. 35A and 35B show graphs of the comparative average peak pressure corresponding to each of the various supports.
Figure 35B:
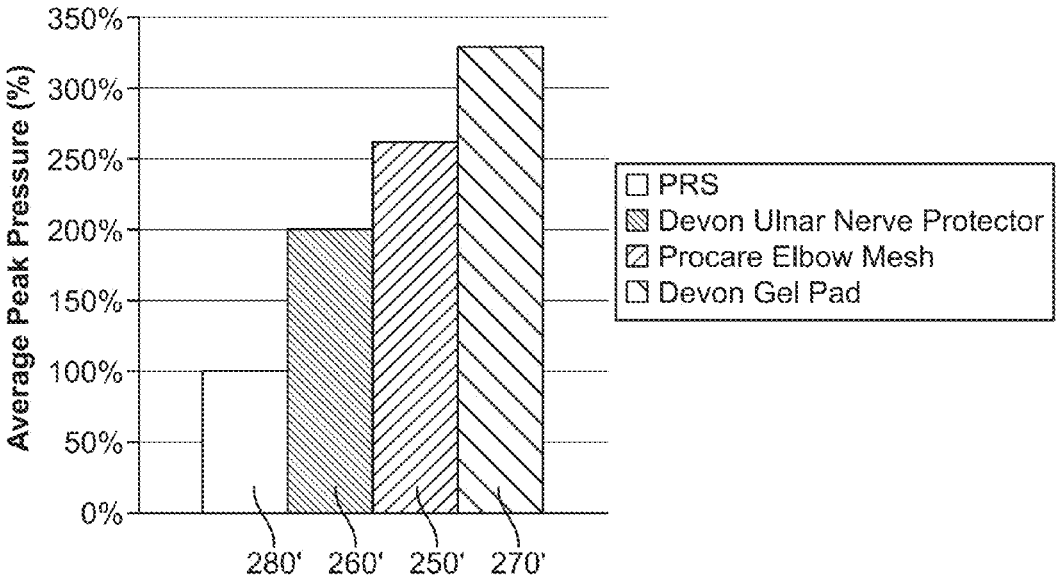

FIG. 35A illustrates a chart of the resulting measured (mmHg) average peak pressure and FIG. 35B illustrates a chart of the resulting percentage (%) average peak pressure of each of the different supports. As shown, the results of the average peak pressure 260' from the Devon™ Ulnar Nerve Protector 262, the average peak pressure 250' from the ProCare Mesh Elbow Protector 252, the average peak pressure 270' from the commercially available Devon™ Gel Pad Arm Board 272, and the average peak pressure 280' from the conformable support 282 are illustrated for comparison. Accordingly, the resulting average peak pressure 280' from the conforming support 282 on the patient elbow PE is about 70% lower compared to the Devon™ Gel Pad Arm Board 272, about 62% lower compared to the ProCare Mesh Elbow Protector 252, and about 50% lower compared to the Devon™ Ulnar Nerve Protector 262.

Figure 36:
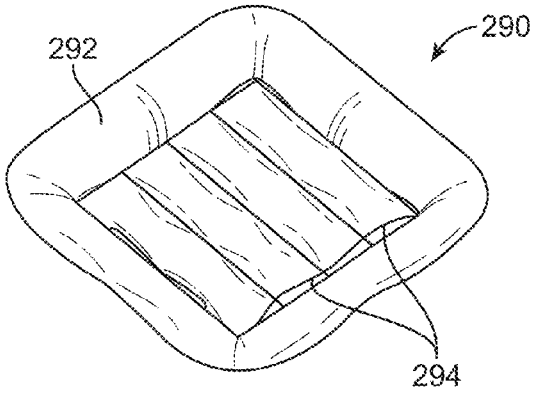
FIG. 36 shows a perspective view of a conforming support having a central portion formed of one of more sub-chambers with a surrounding portion.

In yet another variation of the conforming support, FIG. 36 shows a perspective view of a conforming support 290 having a central portion formed of the one of more sub-chambers 294, as previously described, but with a surrounding portion 292 which defines a surrounding chamber and may completely surround the central portion, as shown. In other examples, the surrounding portion 292 may simply partially surround the central portion by any amount depending upon the desired support as well as the patient anatomy to be supported. In this variation, each of the sub-chambers 294 and the surrounding portion 292 may be in fluid communication with one another through connecting openings to allow for the fluid or gas to move from one region to another, as previously described. Alternatively, each of the sub-chambers 294 may be fluidly connected while remaining isolated from the surrounding portion 292. In yet another variation, the surrounding portion 292 may be fluidly connected to a select number of the sub-chambers 294. Moreover, although the four sub-chambers 294 are illustrated, this is intended to be illustrative and fewer or greater number of sub-chambers may be implemented.

This conforming support 290 may be used to support a number of different regions of the patient's body and this may be used particularly, e.g., as a seat cushion, that the patient may sit upon. As the patient sits upon conforming support 290, the fluid or gas within may be moved from the sub-chambers 294 of the central portion and into the surrounding portion 292 such that central portion reconfigures the conforming support 290 from a flattened configuration in which the fluid or gas within the central portion is urged into the surrounding chamber such that the surrounding portion pivots to and forms a conforming channel sized to support a region of a patient body. Additionally, any number of additional secondary supports may also be placed atop or secured upon the conforming support 290 as well to provide for further support of the patient's body.

Figure 37:
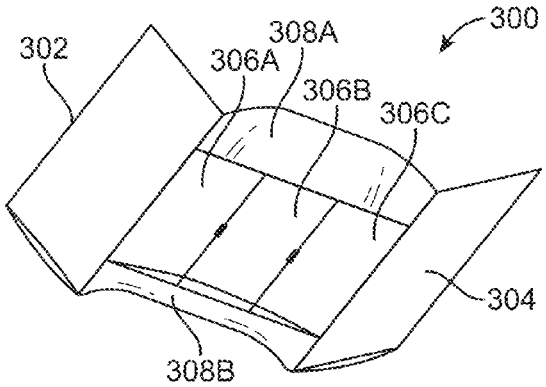
FIG. 37 shows another variation of a conforming support where the side portions extend from a central portion and where the central portion is further separated into sub-chambers.

FIG. 37 shows another variation of a conforming support 300 where side portions 302, 304 may extend from a central portion (as described above). In this example, the side portions 302, 304 may pivot into conformance against the sides of the patient's body, as previously described. The central portion may also incorporate several sub-chambers 306A, 306B, 306C as well but the central portion may be further separated into sub-chambers 308A, 308B which are aligned transversely relative to sub-chambers 306A, 306B, 306C. Each of the parallel sub-chambers 306A, 306B, 306C may be fluidly connected to one another as well as to the side portions 302, 304 but they may also be fluidly connected to the transversely aligned sub-chambers 308A, 308B as well. In other variations, one or more of the sub-chambers may be fluidly isolated to form various supportive patterns depending upon the desired results.

Figure 38:
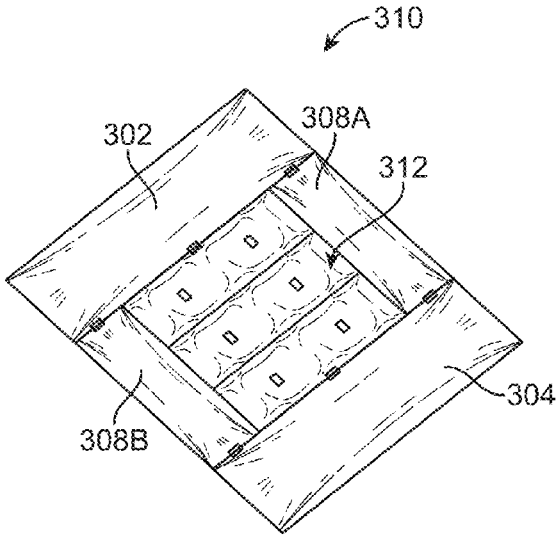
FIG. 38 shows yet another variation similar to FIG. 37 but where the sub-chambers may be further sub-divided via baffles.

Yet another variation is shown in the perspective view of FIG. 38 which shows a conforming support 310 which is similar to the conforming support shown in FIG. 37, but the sub-chambers 306A, 306B, 306C may be further sub-divided via baffles 312 to form multiple supportive sections. Each of the sections may be fluidly connected to one another as well as with all or any number of the other sub-chambers and other portions as well. In this and any of the previous variations, any of the secondary supports described herein may also be used with the conforming supports in any number of combinations depending upon the desired support provided to the patient body.

The applications of the devices and methods discussed above are not limited to particular regions of the body such as the sacrum, trochanter, ischium, head, elbow, heel, etc. but may include any number of further applications. Modification of the above-described device and methods for carrying out the invention, and variations of aspects of the invention that are obvious to those of skill in the art are intended to be within the scope of the claims.

What is claimed is:

1. A method of supporting a region of a patient's body, comprising:

providing a conforming support having a central portion, a first side portion attached to the central portion, and a second side portion attached to the central portion opposite to the first side portion, wherein each of the portions are in fluid communication with one another and is at least partially filled with a fluid or gas;

positioning the region of the patient's body upon the central portion; and reconfiguring the side portions from a flattened configuration to an angled configuration, wherein the fluid or gas within the central portion is urged into the first and/or second side portion such that the side portions pivot to a predetermined height and angle relative to the central portion and form a conforming channel sized to support the region of the patient's body.

2. The method of claim 1 further comprising inflating and/or deflating the conforming support prior to, during, or after positioning the region of the patient's body upon the central portion.

3. The method of claim 2 wherein inflating and/or deflating comprises pumping fluid or gas via a pump.

4. The method of claim 1 wherein reconfiguring the side portions comprises pivoting the side portions to a height up to 20 inches relative to a platform.

5. The method of claim 1 wherein reconfiguring the side portions comprises pivoting the side portions to an angle between 0 to 135 degrees.

6. The method of claim 1 further comprising providing a secondary support at least partially filled with the fluid or gas and positioned upon the conforming support prior to positioning the region of the patient's body.

7. The method of claim 6 further comprising providing one or more pods positionable between the conforming support and secondary support.

8. The method of claim 6 wherein the secondary support is filled with a fluid.

9. The method of claim 1 wherein the conforming support is filled with a gas.

10. The method of claim 1 wherein positioning the region of the patient's body further comprises positioning the conforming support upon a mattress, wheelchair, or seat.

11. The method of claim 1 wherein positioning the region of the patient's body comprises positioning hips, torso, head, elbows, or heels upon the central portion.

12. A method of assisting repositioning of a patient's body, comprising:

providing a conforming support having a central portion, a first side portion attached to the central portion, and a second side portion attached to the central portion opposite to the first side portion, wherein each of the portions are in fluid communication with one another and is at least partially filled with a fluid or gas;

positioning the region of the patient's body upon the central portion;

reconfiguring the side portions from a flattened configuration to an angled configuration, wherein the fluid or gas within the central portion is urged into the first and/or second side portion such that the side portions pivot to a predetermined height and angle relative to the central portion and form a conforming channel sized to support the region of the patient's body; and, elevating a portion of the patient's body opposite to a direction of the patient turning via the central and/or side portions such that the patient body is lifted.

13. The method of claim 12 further comprising inflating and/or deflating the conforming support prior to, during, or after positioning the region of the patient's body upon the central portion.

14. The method of claim 13 wherein inflating and/or deflating comprises pumping fluid or gas via a pump.

15. The method of claim 12 further comprising providing a secondary support at least partially filled with the fluid or gas and positioned upon the conforming support prior to positioning the region of the patient's body.

16. The method of claim 15 further comprising providing one or more pods positionable between the conforming support and secondary support.

17. The method of claim 15 wherein the secondary support is filled with a fluid.

18. The method of claim 12 wherein the conforming support is filled with a gas.

19. The method of claim 12 wherein positioning the region of the patient's body further comprises positioning the conforming support upon a mattress, wheelchair, or seat.

20. The method of claim 12 wherein positioning the region of the patient's body comprises positioning hips, torso, head, elbows, or heels upon the central portion.

* * * * *